United States Patent [19]

Yoshizawa et al.

[11] Patent Number: 4,943,518

[45] Date of Patent: Jul. 24, 1990

[54] DIRECT-POSITIVE SILVER HALIDE PHOTOGRAPHIC LIGHT-SENSITIVE MATERIAL AND METHOD OF PROCESSING IT

[75] Inventors: Tomomi Yoshizawa; Keiji Ogi, both of Tokyo; Yasuo Tosaka; Kazuya Kuramoto, both of Odawara; Yoshiyuki Nonaka, Odawara, all of Japan

[73] Assignee: Konica Corporation, Tokyo, Japan

[21] Appl. No.: 288,022

[22] Filed: Dec. 21, 1988

[30] Foreign Application Priority Data

Dec. 23, 1987 [JP] Japan ..... 62-326066
Feb. 29, 1988 [JP] Japan ..... 63-47179

[51] Int. Cl.[5] ..... G03C 7/38; G03C 7/30

[52] U.S. Cl. ..... 430/378; 430/505; 430/506; 430/547; 430/558; 430/567

[58] Field of Search ..... 430/547, 558 R, 378, 430/940, 567, 506, 505

[56] References Cited

U.S. PATENT DOCUMENTS

| | | | |
|---|---|---|---|
| 4,444,865 | 4/1984 | Silverman et al. | 430/940 |
| 4,749,644 | 6/1988 | Tosaka et al. | 430/547 |
| 4,801,520 | 1/1989 | Inoue et al. | 430/547 |
| 4,830,956 | 5/1989 | Waki | 430/558 |

FOREIGN PATENT DOCUMENTS

| | | |
|---|---|---|
| 230997 | 8/1987 | European Pat. Off. . |
| 1810464 | 9/1969 | Fed. Rep. of Germany . |

OTHER PUBLICATIONS

Patent Abstracts of Japan, vol. 11, No. 233 (P-600) [2680], 7/30/87, JPA 62-44731.

*Primary Examiner*—Richard L. Schilling
*Attorney, Agent, or Firm*—Jordan B. Bierman

[57] ABSTRACT

A direct positive type silver halide color photographic material and an image forming method are disclosed. A green sensitive emulsion layer of the photographic material comprises silver halide grains having at least two peaks on the size distribution curve thereof and the grain size corresponding to the smallest grain size peak among the peaks is not more than 0.3 μm and a magenta coupler represented by the following Formula (M-I);

Formula (M-I)

wherein Z is a group of non-metal atoms necessary to complete a nitrogen-containing heterocyclic ring; X is a hydrogen atom or a split-off group and R is a substituent. The photographic material is developed with a color development in the presence of a fogging agent to directly form the positive image after imagewise exposure to light. Thus obtained image is improved in a increased maximum density, lowered minimum density and wider exposure latitude. Stability of gradation with respect to variation of development conditions is also improved.

51 Claims, No Drawings

DIRECT-POSITIVE SILVER HALIDE PHOTOGRAPHIC LIGHT-SENSITIVE MATERIAL AND METHOD OF PROCESSING IT

FIELD OF THE INVENTION

The present invention relates to a direct-positive silver halide photographic light-sensitive material that can obtain positive images by subjecting it to developing in the presence of a fogging agent, and a method of processing it. More particularly it is concerned with a direct-positive silver halide photographic light-sensitive material that can have a sufficiently high maximum density, yet having a sufficiently low minimum density, can have a good image quality, also can have a broad gradient, and further can be processed with a stable balance of the gradation at the toe against variations of processing conditions, and a method of processing the same.

BACKGROUND OF THE INVENTION

Mainly two types are hitherto known as methods of forming a direct-positive image. One of them is a method in which fog nuclei are previously formed in silver halide grains, and the fog nuclei are imagewise destroyed by solarization, Herschel effect or the like, and the remaining fog nuclei are developed to form a positive image. The other type is a method in which an internal latent image silver halide emulsion not previously fogged is used, which is subjected to fogging treatment (development nucleus formation treatment) after imagewise exposure and then surface development is carried out, or the surface development is carried out while applying fogging treatment (development nucleus formation treatment) after imagewise exposure, to form a positive image.

Of the two methods for the formation of positive image as described above, the latter type method can achieve in general a higher speed than the former type method, thus being suited to the application in which a high speed is required.

In the present technical field, various techniques have been hitherto known. For example, methods are known which are described in U.S. Pat. Nos. 2,592,250, 2,466,957, 2,497,875, 2,588,982, 3,762, 266, 3,761,276 and 3,796,577, and British Pat. No. 1,151,363.

The above methods for the fogging treatment (development nucleus formation treatment) may be carried out either by giving the whole surface exposure or by chemical procedures using a fogging agent, also by using a strong developing solution, or further by heating or the like.

Employment of these known techniques enables preparation of photographic light-sensitive materials that form positive images, but more improvement in photographic performance and solution of problems in manufacture have been sought in order to bring these photographic light-sensitive materials to be applicable in every photographic field.

In the present technical field, it is commonly known to prepare a direct-positive silver halide photographic light-sensitive material with use of two or more kinds of internal latent image emulsions. For example, U.S. Pat. No. 4,035,185 discloses that core/shell emulsions with varied degrees of internal chemical sensitization are mixed, but the emulsion in which the degree of internal chemical sensitization has been increased can have no sufficient efficiency for the formation of positive images, can also have no sufficient maximum density despite a mixed emulsion, and has been desired to achieve a still higher maximum density.

Japanese Patent Publications Open to Public Inspection (hereinafter referred to as Japanese Patent O.P.I. Publications) Nos. 111938/1983 and 77436/1984 discloses the mixing and double laver coating of a core/-shell emulsion and a fine grain emulsion. The fine grain emulsion, however, can not form an image when used alone, and is used merely to improve covering power, so that it can not enhance the photographic performances possessed by respective emulsions, also resulting in a higher minimum density.

Also, in the direct-positive silver halide photographic light-sensitive materials, developing is carried out in the presence of a fogging agent after imagewise exposure, thereby forming a fog nucleus in silver halide emulsion and carrying out the development, so that their photographic performances greatly depend on the conditions under which the emulsion is fogged, i.e., the type and amount of fogging agents or the character of developing solutions. Accordingly, in regard to, for example, the developing solutions, there is a demand for a direct-positive silver halide photographic light-sensitive material that has stable photographic performances against changes in composition or the lowering of developing ability owing to running or fatigue.

Moreover, in the direct-positive silver halide photographic light-sensitive materials, an attempt to reproduce with fidelity the lightness of objects results in requirement of a soft gradation performance having a broad exposure latitude. Hence, for example, the broad exposure latitude is obtained, or further the gradation is controlled, by mixing internal latent image silver halide grains having different grain size and substantially the same light-sensitive wavelength or by overlapping them by coating in different layers. In this occasion, however, because of employment of the grains having different grain size, the development proceeds in a different manner for each grain having different grain size, and for this reason the development proceeds slowly in respect of larger grains and the development proceeds quickly in respect of smaller grains, thus sometimes resulting in the so-called poorly continuous gradation that the gradation greatly differs at the toe and the shoulder of the characteristic curve thereof, particularly in the direct-positive color photographic light-sensitive materials, this point has not been sufficiently settled despite the importance of the balance in the toe portion of the characteristic curve. Satisfactory results are not necessarily obtained also in regard to the stability of direct-positive silver halide photographic light-sensitive materials, when the development conditions have been varied.

As a measure relating to this stability against the variation of developing conditions, some methods have been proposed in which emulsion grains are made development-active, e.g., the emulsion grains are made to have a small grain size, or a coupler capable of rapidly reacting with an oxidized developing agent to used, but these are still not only insufficient for obtaining always stable performances, but also accompanied with an increase in minimum density, undesirably.

SUMMARY OF THE INVENTION

An object of the present invention is to provide a direct-positive silver halide photographic light-sensitive material that have a good image quality having a sufficiently high maximum density, yet having a sufficiently low minimum density, and at the same time not only have a broad exposure latitude, i.e., have a broad gradient and good gradation reproducibility, but also have the photographic performance that affords a stable balance of the gradation at the toe of the characteristic curve against variations of developing conditions, and a method of processing the same.

The above object of the present invention was achieved by a direct-positive silver halide photographic light-sensitive material which comprises a support having thereon a blue-sensitive emulsion layer, a green-sensitive emulsion layer and a red-sensitive emulsion layer, and is capable of obtaining a positive image by developing with a color developer in the presence of a fogging agent after exposure to light;

wherein the green-sensitive emulsion layer comprises;

silver halide grains having at least two peaks on the grain size distribution curve thereof, where the grain size corresponding to the smallest grain size peak among said at least two peaks is not more than 0.3 μm; and at least one of the magenta couplers represented by Formula (M-I).

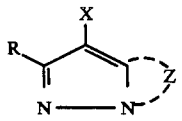

Formula (M-I)

wherein Z represents a group of non-metal atoms necessary to complete a nitrogen-containing heterocyclic ring which may have a substitutent; X represents a hydrogen atom or a group capable of being split off upon reaction with the oxidized product of a color developing agent; and R represents a hydrogen atom or a substituent.

The above object was also achieved by a method of processing a direct-positive silver halide photographic light-sensitive material, comprising subjecting the above light-sensitive material to color development in the presence of a fogging agent.

DETAILED DESCRIPTION OF THE INVENTION

The direct-positive silver halide photographic light-sensitive material (hereinafter "direct-positive light-sensitive material") according to the present invention has at least one blue-sensitive emulsion layer, green-sensitive emulsion layer and red-sensitive emulsion layer, respectively, on a support. In the present light-sensitive material, each layer of at least one blue-sensitive emulsion layer, green-sensitive emulsion layer and red-sensitive emulsion layer, respectively, may comprise a single layer or plural layers. In the case of plural layers, a non-light-sensitive emulsion layer or other light-sensitive emulsion layer may be provided between the layer nearest to the support and the layer farthest from the support. The above green-sensitive emulsion layer comprises grains having at least two peaks in the grain size distribution curve of the silver halide grains contained in said layer. In the case when the green-sensitive emulsion layer comprises plural layers, the grains refer to those having at least two peaks in the grain size distribution curve obtained by measuring the grain size distribution curve of the whole silver halide grains of the respective silver halide grains contained in the plural layers coated per unit area.

In the following, the manner by which the grain size distribution is measured will be described in detail. In the case of spherical silver halide grains, the grain size of the silver halide emulsion grains mentioned here refers to the diameter of a grain. In the case of silver halide grains having forms other than the spherical form, it means the diameter obtained when the projected image of a grain has been calculated into a round image having the same area. The grain size can be obtained, for example, by taking a photograph with enlargement of from 10,000 to 50,000 magnifications using an electron microscope and actually measuring the diameter of the grains on the resulting print or the area obtained by the projected image. (The grains to be measured are selected at random in the number of not less than 1,000.)

The position at which $ni \times ri^3$ shows a maximum value when the product of frequency ni of a grain having grain size ri, and $ri^3$, i.e., $ni \times ri^3$, is plotted with respect to ri is defined to be the peak in the grain size distribution curve in the present invention.

The silver halide grains contained in the green-sensitive emulsion layer according to the present invention are required to have at least two peaks in the grain size distribution curve of the grains, but may more preferably have at least three peaks in the grain size distribution curve.

In the present invention, there are no particular limitations on the size of the respective peaks in the above peaks of the grain size distribution curve, but the weight of silver halide grains included in a grain size range of ±20% centering on the grain size at the respective peaks may preferably comprise not less than 5%, more preferably not less than 10%, of the weight of the whole silver halide grains.

In the grain size distribution curve of the silver halide grains in the present invention, there are no particular limitations on the extent to which any adjacent peaks stand apart in their grain size, but at least the grain size at the peaks stands not less than 10% apart from the grain size based on a greater grain size.

The green-sensitive emulsion layer may preferably contain at least two kinds of silver halide emulsions having different average grain size. In the case when the green-sensitive emulsion layer comprises a single layer, the layer contains, in a preferred embodiment, at least two kinds of silver halide emulsions having different average grain size. Also, in the case when the green-sensitive emulsion layer comprises plural layers, each layer may have the same or different grain size distribution, so long as the grains have at least two peaks in the grain size distribution curve as a whole.

In a preferred embodiment of the present invention, at least two kinds of silver halide emulsion different in average grain size are separately contained in different green-sensitive emulsion layers.

For instance, in a case that the green-sensitive emulsion layer is comprises two emulsion layers and one of which contains an emulsion comprising silver halide grains having a smaller average grain size and the other of which contains silver halide grains having a larger average grain size, the size distribution curve of the above whole grains including the grains of a smaller average grain size and the grains of a larger average grain size coated in an unit area has at least two peaks.

Among at least two peaks in the grain size distribution curve of the silver halide grains contained in the green-sensitive emulsion layer according to the present invention, the grain size corresponding to the smallest grain size peak is not more than 0.3 μm, preferably 0.05 μm to 0.3 μm, and, among the above at least two peaks, there are no particular limitations on the grains size at the peaks other than the smallest grain size peak, but the grain size may preferably be not more than 1.5 μm. More preferably it may be not more than 1.0 μm, and particularly preferably not more than 0.7 μm.

The silver halide emulsion contained in the green-sensitive emulsion layer according to the present invention contain a magenta coupler represented by Formula (M-I).

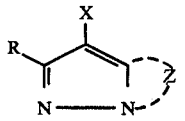

Formula (M-I)

In the magenta coupler represented by the above Formula (M-I), Z represents a group of non-metal atoms necessary to complete a nitrogen-containing heterocyclic ring, and the ring formed by said Z may have a substitutent.

X represents a hydrogen atom or a group capable of being split off upon reaction with the oxidized product of a color developing agent.

R represents a hydrogen atom or a substituent.

There are no particular limitations on the substituent represented by R, but it typically includes groups such as alkyl, aryl, anilino, acylamino, sulfonamide, alkylthio, arylthio, alkenyl and cycloalkyl. Besides these, it also includes a halogen atom, groups such as cycloalkenyl, alkynyl, a heterocyclic ring, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl and heterocyclic thio, a spiro compound residual group, and a bridged hydrocarbon compound residual group.

The above alkyl group represented by R may preferably include those having 1 to 32 carbon atoms, which may be either straight-chain or branched.

The aryl group represented by R may preferably include a phenyl group.

The acylamino group represented by R includes an alkylcarbonylamino group and an arylcarbonylamino group.

The sulfonamide group represented by R includes an alkylsulfonylamino group and an arylsulfonylamino group.

The alkyl component or aryl component in the alkylthio group or arylthio group represented by R includes the above alkyl group or aryl group represented by R.

The alkenyl group represented by R may preferably include those having 2 to 32 carbon atoms; and the cycloalkyl group, those having 3 to 12 carbon atoms, and particularly 5 to 7 carbon atoms. The alkenyl group may be either straight-chain or branched.

The cycloalkenyl group represented by R may preferably include those having 3 to 12 carbon atoms, and particularly preferably 5 to 7 carbon atoms.

The sulfonyl group represented by R includes an alkylsulfonyl group and an arylsulfonyl group;

the sulfinyl group includes an alkylsulfinyl group and an arylsufinyl group;

the phosphonyl group includes an alkylphosphonyl group, an alkoxyphosphonyl group, an aryloxyphosphonyl group and an arylphosphonyl group;

the acyl group includes an alkylcarbonyl group and an arylcarbonyl group;

the carbamoyl group includes an alkylcarbamoyl group and an arylcarbamoyl group;

the sulfamoyl group includes an alkylsulfamoyl group and an arylsulfamoyl group;

the acyloxy group includes an alkylcarbonyloxy group and arylcarbonyloxy group;

the carbamoyloxy group includes an alkylcarbamoyloxy group and an arylcarbamoyloxy group;

the ureido group includes an alkylureido group and an arylureido group;

the sulfamoylamino group includes an alkylsulfamoylamino group and an arylsulfamoylamino group;

the heterocyclic ring may preferably include those of 5 to 7 members, specifically including a 2-furyl group, a 2-thienyl group, 2-pyrimidinyl group and 2-benzothiazolyl group;

the heterocyclic oxy group may preferably include those having a heterocyclic ring of 5 to 7 members, including, for example, a 3,4,5,6-tetrahydropyranyl-2-oxy group and a 1-phenyltetrazole-5-oxy group;

the heterocyclic thio group may preferably include a heterocyclic thio group of 5 to 7 members, including, for example, a 2-pyridylthio group, a 2-benzothiazolylthio group and a 2,4-diphenoxy-1,3,5-triazole-6-thio group;

the siloxy group includes a trimethylsiloxy group, a triethylsiloxy group and a dimethylbutylsiloxy group;

the imido group includes a succinimido group a 3-heptadecylsuccinimido group, a phthalimido group and a glutalimido group;

the spiro compound residual group includes spiro[3.3]heptan-1-yl; and the bridged hydrocarbon compound residual group includes bicylo[2.2.1]heptan-1-yl, tricyclo[3.3.1.1$^{3,7}$]decan-1-yl and 7,7-dimethylbicyclo[2.2.1]heptan-1-yl.

The group represented by X, capable of being split off through the reaction with an oxidized product of a color developing agent, may include, for example, a halogen atom such as a chlorine atom, a bromine atom or a fluorine atom, and groups such as alkoxy, aryloxy, heterocyclic oxy, acyloxy, sulfonyloxy, alkoxycarbonyloxy, aryloxycarbonyl, alkyloxalyloxy, alkoxyoxalyloxy, alkylthio, arylthio, heterocyclio thio, alkyloxythiocarbonylthio, acylamino, sulfonamido, a nitrogen-containing heterocyclic ring bonded with a N atom, alkyloxycarbonylamino, aryloxycarbonylamino, carboxyl, and

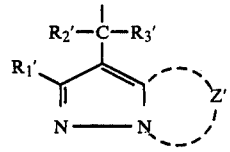

($R_1'$ represents the same as defined for the above R, and Z', the same as defined for the above Z; and $R_2'$ and $R_3'$ each represent a hydrogen atom, an aryl group, an alkyl group or a heterocyclic group.), but preferably includes a halogen atom, particularly a chlorine atom.

The nitrogen-containing heterocyclic group formed by Z or Z' may include a pyrazole ring, an imidazole ring, a triazole ring or a tetrazole ring, and the substituent the above ring may have may include those described for the above R.

The coupler represented by Formula (M-I) is more specifically represented, for example, by the following Formulas (M-II) to (M-VII).

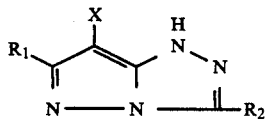

Formula (M-II)

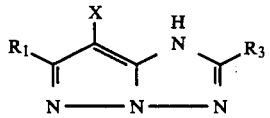

Formula (M-III)

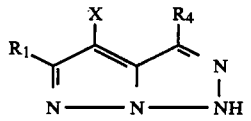

Formula (M-IV)

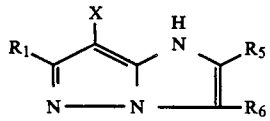

Formula (M-V)

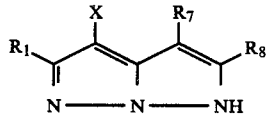

Formula (M-VI)

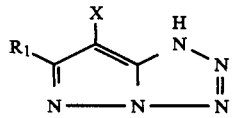

Formula (M-VII)

In the above Formulas (M-II) to (M-VII), $R_1$ to $R_8$ and X represent the same as defined for the above R and X.

Among Formula (M-I), preferred is the one represented by Formula (M-VIII) shown below.

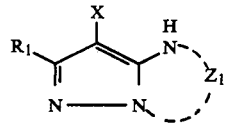

Formula (M-VIII)

wherein $R_1$, X and $Z_1$ represent the same as defined for R, X and Z in Formula (M-I).

Among the magenta couplers represented by the above Formulas (M-II) to (M-VII), a preferred magenta coupler is the magenta coupler represented by Formula (M-II) or (M-III) and particularly preferred is one represented by Formula (II).

Most preferred as the substituent R or $R_1$ on the above heterocyclic ring is a substituent represented by Formula (M-IX) shown below.

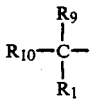

wherein $R_9$, $R_{10}$ and $R_{11}$ each represent the same as defined for the above R.

Any two of the above $R_9$, $R_{10}$ and $R_{11}$, for example, $R_9$ and $R_{10}$, may also combine to form a saturated or unsaturated ring as exemplified by cycloalkane, cycloalkene and a heterocyclic ring, and $R_{11}$ may further be combined to said ring to constitute a bridged hydrocarbon compound residual group.

Particularly preferred in Formula (M-IX) are;

(i) the case when at least two of $R_9$ to $R_{11}$ are alkyl groups; and (ii) the case when one of $R_9$ to $R_{11}$, for example, $R_{11}$, is a hydrogen atom, and other two, $R_9$ and $R_{10}$, are combined to form cycloalkyl together with the route carbon atom.

Further particularly preferred in (i) is the case when any two of $R_9$ to $R_{11}$ are alkyl groups and the remaining one is a hydrogen atom or an alkyl group.

Also, the substituent the ring formed by Z in Formula (M-I) or the ring formed by $Z_1$ in Formula (M-VIII) may have, and $R_2$ to $R_8$ in Formulas (M-II) to (M-VI) may preferably include those represented by Formula (M-X) shown below.

$$-R^1-SO_2-R^2 \qquad \text{Formula (M-X)}$$

In the formula, $R^1$ represents an alkylene group, and $R^2$ represents an alkyl group, a cycloalkyl group or an aryl group.

The alkylene group represented by $R^1$ may preferably have two or more, more preferably 3 to 6, carbon atoms at the straight-chain moiety, regardless of being straight-chain or branched.

The cycloalkyl group represented by $R^2$ may preferably include those of 5 or 6 members.

Typical examples of the compounds according to the present invention are shown below.

1

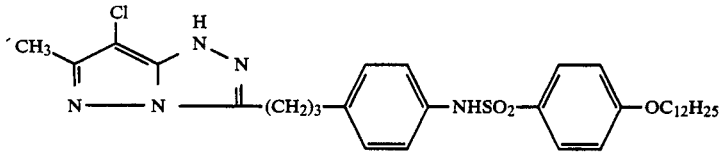

2

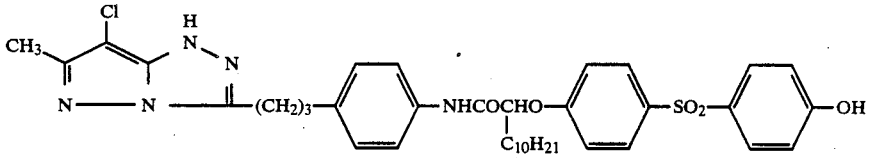

-continued
3
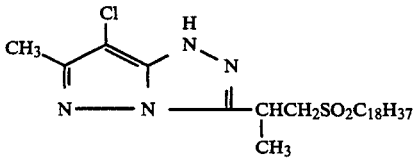
4
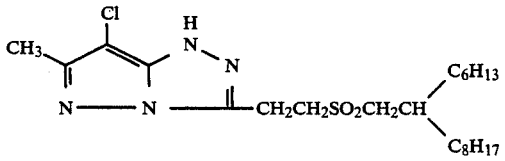
5
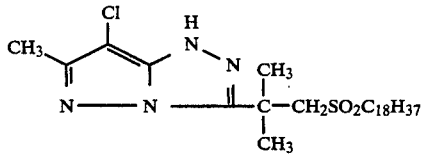
6
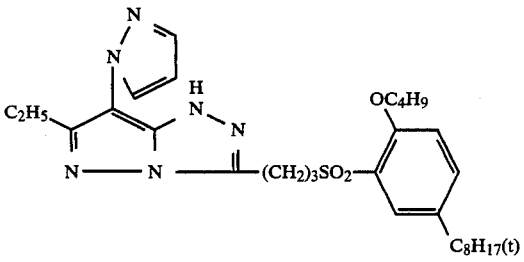
7
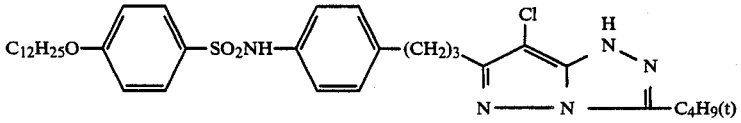
8
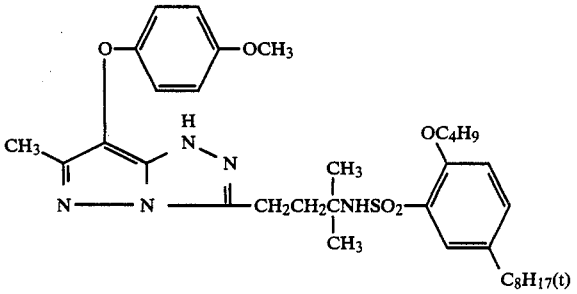
9
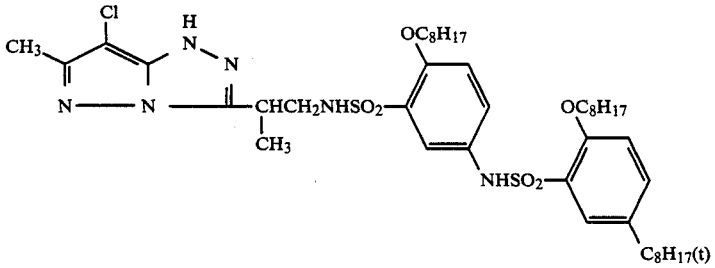

-continued
10
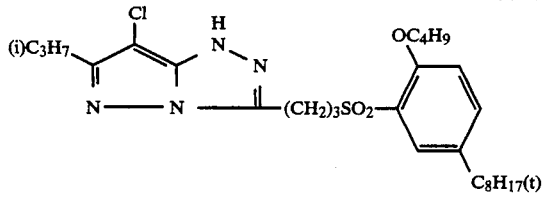
11
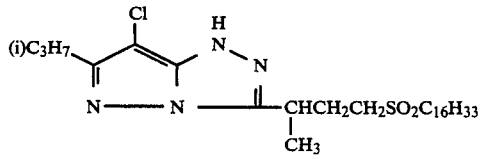
12
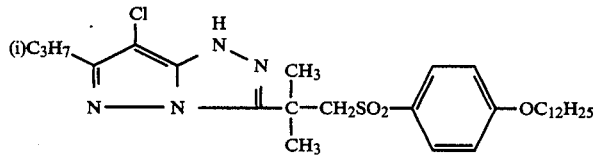
13
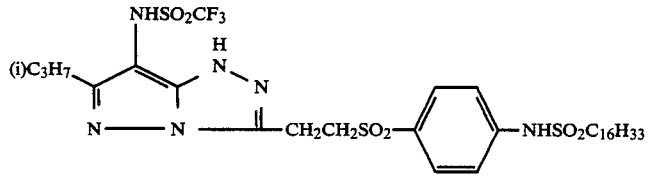
14
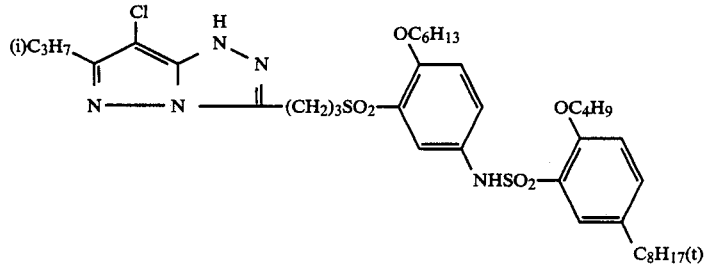
15
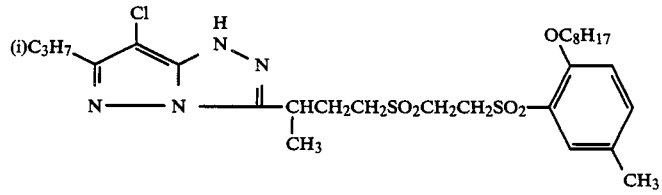
16
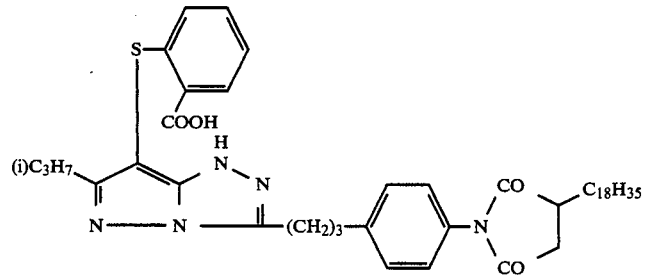
17
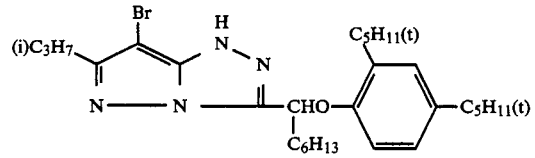

-continued
18
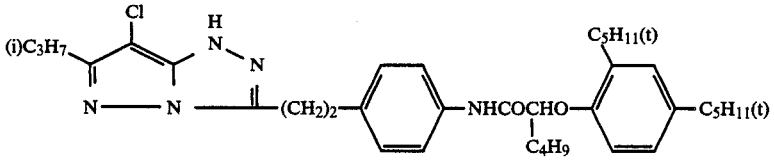
19
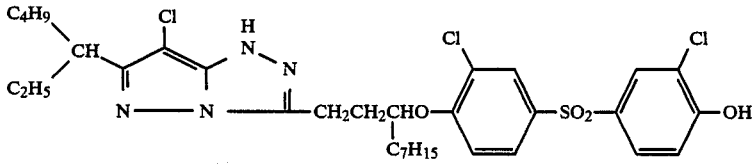
20
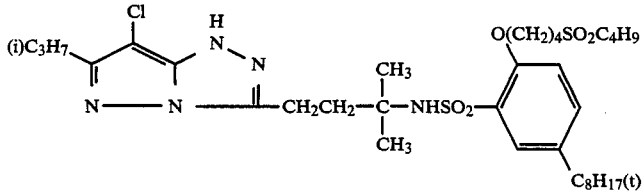
21
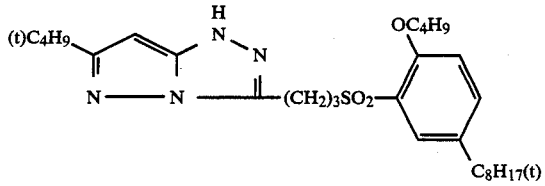
22
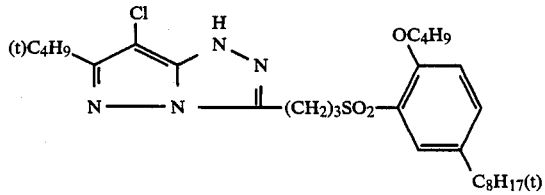
23
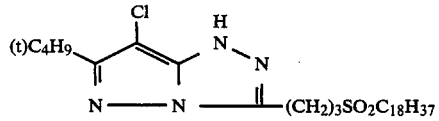
24
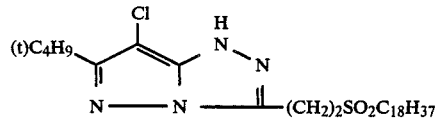
25
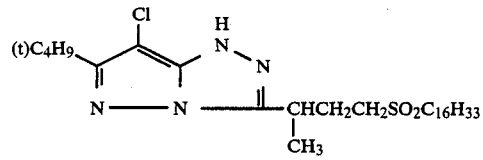
26
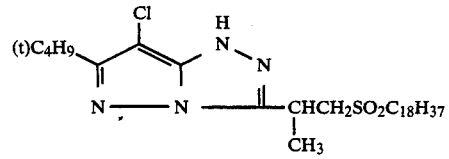

-continued
27
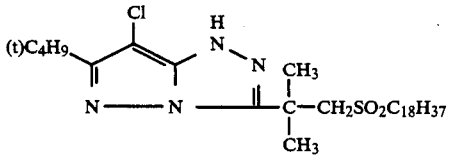
28
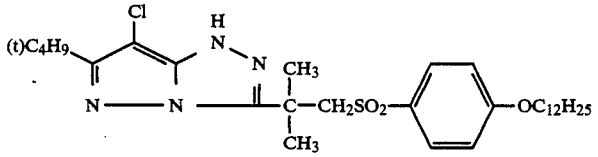
29
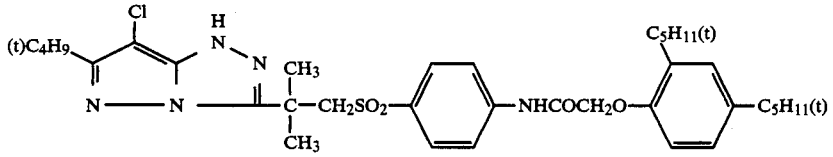
30
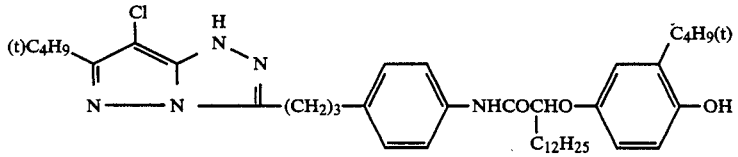
31
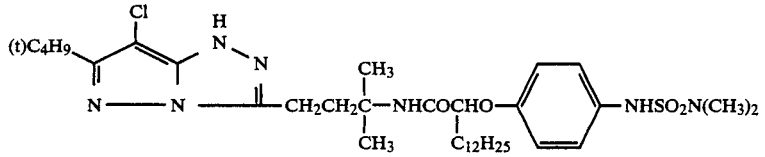
32
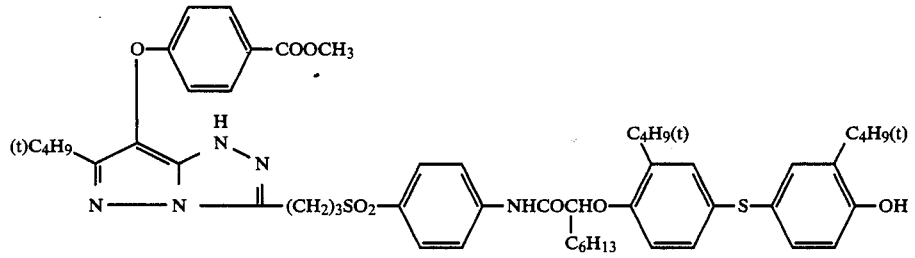
33
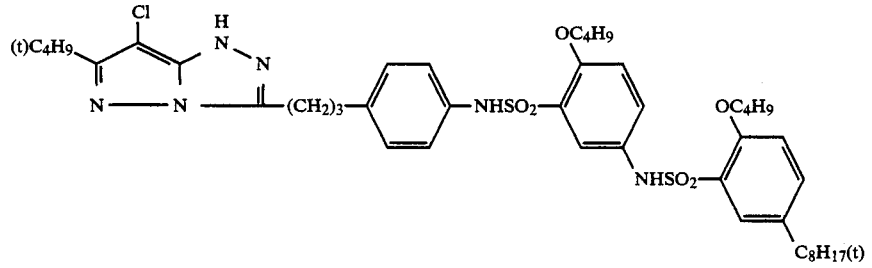
34
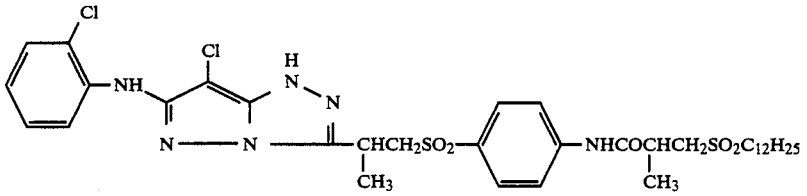

-continued
35
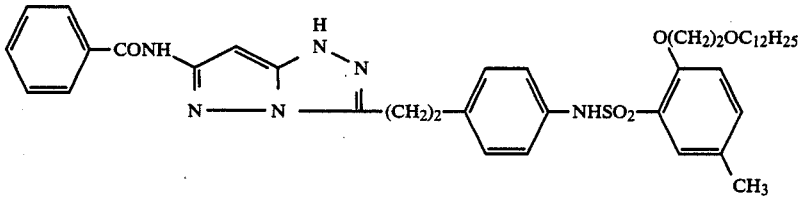
36
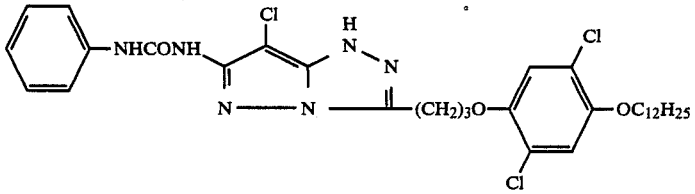
37
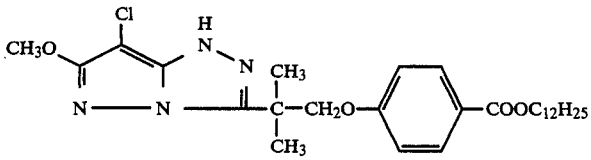
38
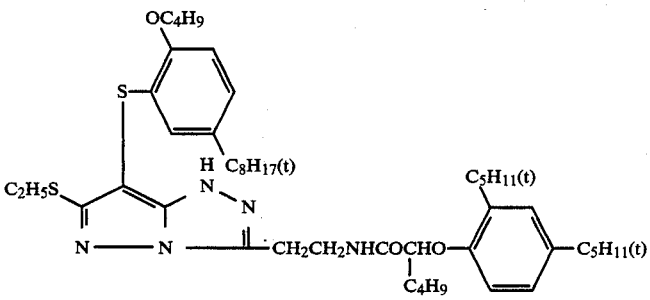
39
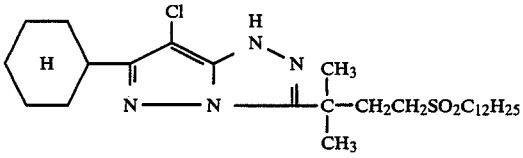
40
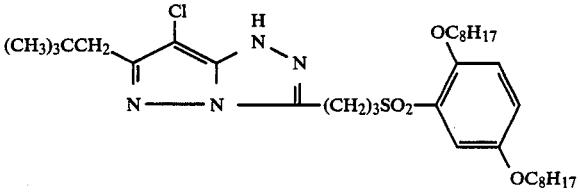
41
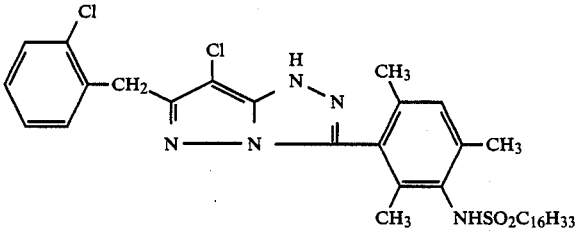

-continued
42
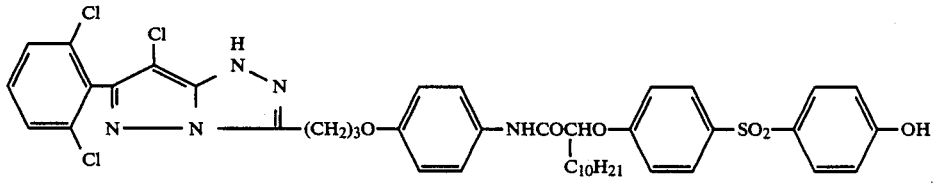
43
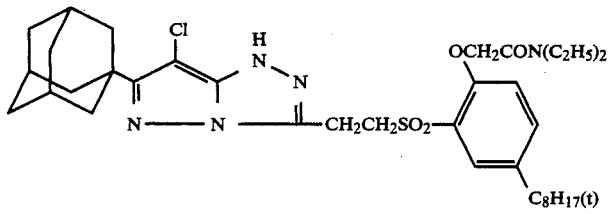
44
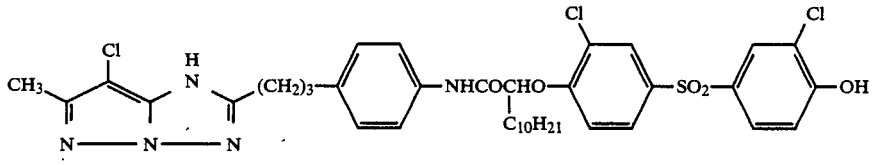
45
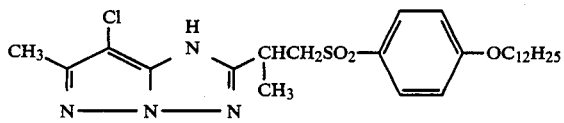
46
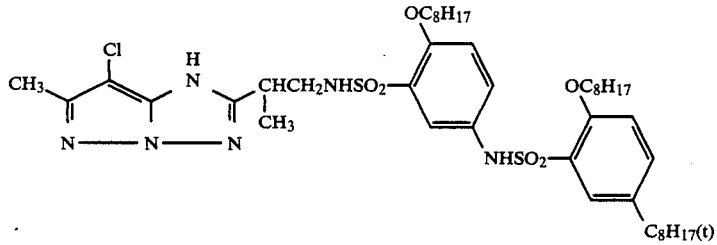
47
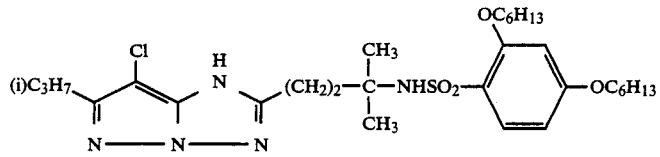
48
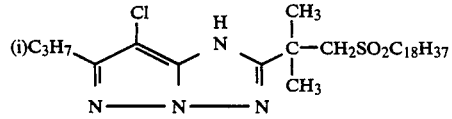
49
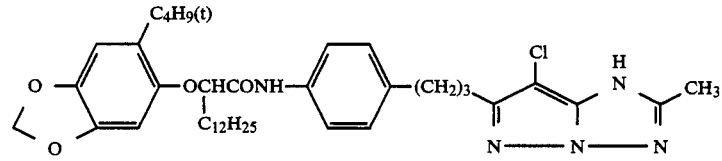

-continued
50
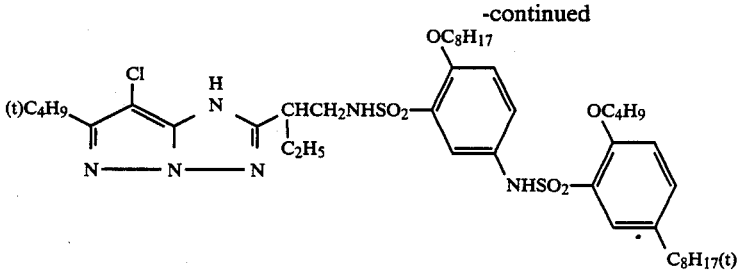
51
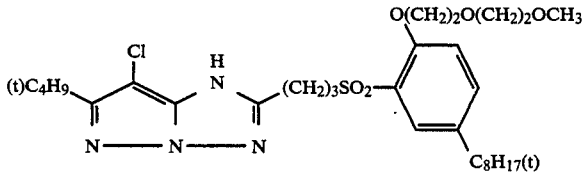
52
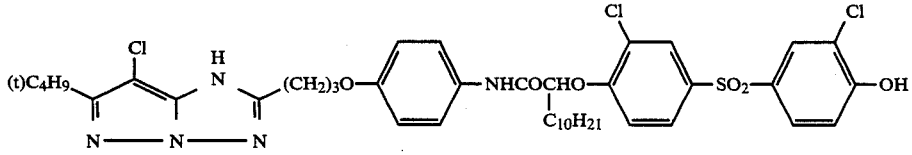
53
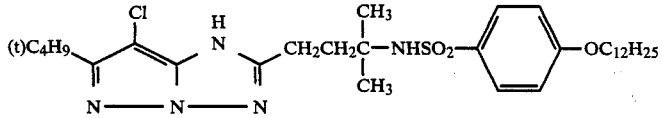
54
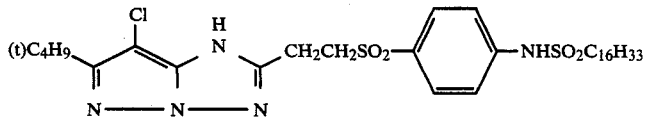
55
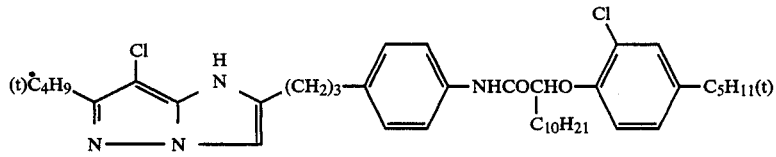
56
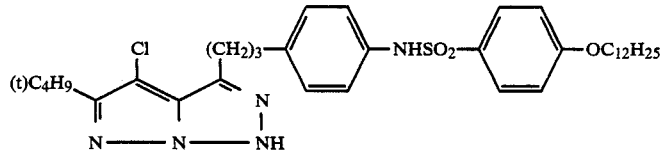
57
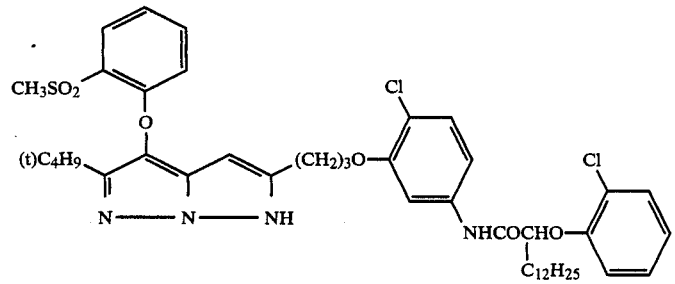
58
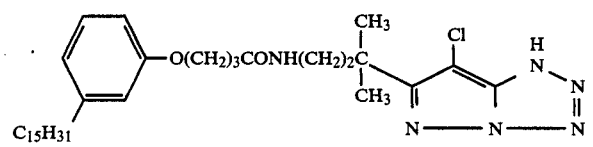

-continued

59

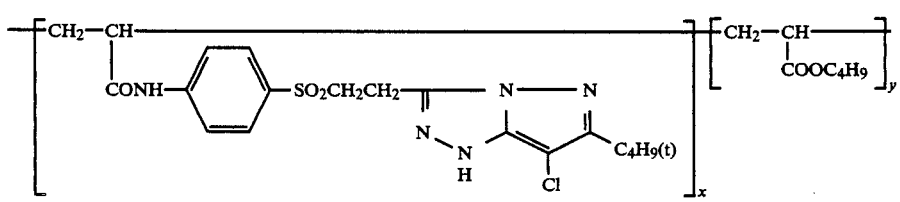

x:y = 50:50

60

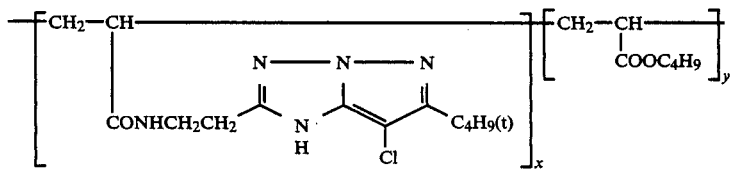

x:y = 50:50

In addition to the above typical examples of the compounds according to the present invention, examples of the compounds according to the present invention may also include the compounds shown as Nos. 1 to 4, 6, 8 to 17, 19 to 24, 26 to 43, 45 to 59, 61 to 104, Ωto 121, 123 to 162 and 164 to 223 among the compounds described at pages 66 to 122 of the specification of Japanese Patent O.P.I. Publication No. 166339/1987.

The above couplers can be synthesized by making reference to Journal of the Chemical Society, Perkin I (1977), 2047-2052, U.S. Pat. No. 3,725,067, Japanese Patent O.P.I. Publications Nos. 99437/1984, 42045/1983, 162548/1984, 171956/1984, 33552/1985, 43659/1985, 172982/1985 and 190779/1985, etc.

The magenta couplers of the present invention can be used usually in the range of from $1\times10^{-3}$ mol to 1 mol, and preferably from $1\times10^{-2}$ mol to $8\times10^{-1}$ mol, per mol of silver halide.

The couplers of the present invention can also be used in combination with magenta couplers of different types.

In green-sensitive layer of the photographic material of the present invention, at least two silver halide emulsions different in average grain size are separately coated in plural layers, or at least one emulsion having at least two peaks in its grain size distribution curve is coated in one or more layers.

Methods of preparing the silver halide emulsion used in the present invention will be described below in detail.

One of the methods of preparing emulsions so as to give a desired grain size distribution is a method in which at least two kinds of emulsions having different grain size are mixed. In this instance, the respective emulsions may preferably comprise a monodisperse emulsion.

In another method of preparing an emulsion, the emulsion is so prepared that the grain size distribution curve of the present invention can be obtained by using a single emulsion, where, for example, silver ions and halide ions are fed to a seed emulsion, and an additional seed emulsion is added when silver halide crystals has grown to have a given particle size in a monodisperse state, and thereafter silver ions and halide ions are again fed, so that the silver halide grains having two peaks in the grain size distribution curve in the present invention can be obtained.

In still another method, silver halide grains are made to grow under such a condition or rate of addition that any new silver halide nucleus may not be formed, thereafter silver halide nuclei are made to grow under such a condition or rate of addition that maV temporarily cause the formation of new nuclei of silver halide grains and thereafter the rate of addition is so controlled as not to again form any new silver halide nucleus, so that the silver halide grains having two peaks can also be prepared.

The silver halide grains used in the present invention may be those obtained by any of an acidic method, a neutral method and an ammoniacal method. The grains may be grown at one time, or may be grown after making seed grains. The method of making seed grains and the method of growing them maV be the same or different. The silver halide emulsion containing such silver halide grains may be prepared either by simultaneously mixing halide ions and silver ions or by mixing any one of them into an aqueous solution in which the other of them is present. The grains may also be made to grow by simultaneously adding halide ions and silver ions while controlling the pH and pAg in a mixing vessel, taking into consideration the critical growth rate of silver halide crystals. This method can yield silver halide grains having regular crystal forms and nearly uniform grain size. It is also possible to change the halogen composition of the grains with use of a conversion process after the growth.

The silver halide grain according to the present invention may comprise at least two phases, more specifically, at least two phases having different halogen composition from each other, and one of the phases positioned at the outermost side maV only cover at least part of the other phase. The grain may have the so-called core/shell structure, in which a second phase forms a core and a first phase serves as a shell to cover the core, or have the structure in which the first phase covers part of the second phase.

The silver halide grain according to the present invention may be constituted of three or more layers. For example, it may be a silver halide grains having a three layer constitution comprising a core serving as the innermost central nucleus, an internal shell that covers the core, and the outermost shell layer that covers the internal shell. Hereinafter, to simplify the description, the grain having the two layer structure will be taken up to make description regarding a first phase positioned at the outermost side as the shell layer, and a second phase adjacent thereto as the core. However, the silver halide grain of the present invention may not be limited to the grain of two-layer structure.

The core of the silver halide grain according to the present invention may preferably contain less silver chloride than the silver chloride contained in the shell layer.

The core may preferably be mainly comprised of silver bromide, and may further contain silver chloride and/or silver iodobromide. The silver halide grain that forms the core may be of any form, as exemplified by a cube, a regular octahedron, a dodecahedron or a tetradecahedron, these of which may be used in a mixed state, and also may be a spherical, plate-like or formless grain, these of which may be used in an appropriately mixed state. In working the present invention, the average grain size and grain size distribution of the silver halide grains that constitute the core or internal shell can be made to vary in a vast range depending on the desired photographic performances, but the grain size distribution with a narrower distribution is more preferred. Specifically, 90% by weight of the silver halide grains that constitute the core may preferably have a grain size included in the range of plus or minus 40%, and more preferably plus or minus 30%, of the average Orain size.

tn other words, the silver halide grains that constitute the cores may preferably be substantially monodisperse.

The silver halide grains whose cores are monodisperse are herein meant to be those in which, in the silver halide grains that constitute the cores, the weight of silver halide grains included in a grain size range of ±20% centering on an average grain size $\bar{r}$ comprise not less than 60%, preferably not less than 70%, and particularly preferably not less than 80%, of the weight of the whole silver halide grains.

Here, the average grain size $\bar{r}$ means such a grain size ri that the product of frequency ni of a grain having grain size ri, and $ri^3$, i.e., $ni \times ri^3$, may come to be maximum (effective number: three figures; minimum figures are rounded off).

The grain size mentioned here also refers to the diameter of a grain in the case of spherical silver halide grains. In the case of silver halide grains having forms other than the spherical form, it refers to the diameter obtained when the projected image of a grain has been calculated into a round image having the same area.

As methods of preparing the above monodisperse core emulsions, the double-jet method can be used which is disclosed, for example, in Japanese Patent Examined Publication No. 36890/1973, and Japanese Patent O.P.I. publications No. 48520/1979 and No. 65521/1979. Besides this, the premix method can be also used which is described in Japanese Patent O.P.I. Publication No. 158220/1979.

The core may preferably have less lattice defects, which is disclosed, for example, in U.S. Pat. No. 2,592,250. The emulsion prepared by a conversion method is not suitable as the core. The grains prepared by the above double jet method while controlling the pH and pAg during preparation have less lattice defects, and are preferred as the core.

The core can be prepared in the presence of a silver halide solvent. There can be used thioethers disclosed in U.S. Pat. No. 3,574,628 thiourea derivatives disclosed in Japanese Patent O.P.I. Publication No. 77737/1980, and imidazoles disclosed in Japanese Patent O.P.I. Publication No. 100717/1979. In a preferred embodiment of the present invention, it is also preferred to used ammonia as the silver halide solvent.

In the silver halide grains according to the present invention, the shell layer may preferably cover not less than 50% of the surface area of the grain that constitutes the core. The shell layer may contain silver bromide or silver iodide so far as any photographic performances are adversely affected. Part of the shell layer may be converted into silver bromide or silver iodide by using a little amount of a water-soluble bromide or iodide.

The shell layer may entirely cover the core, or may selectively cover part of the core, but may preferably cover not less than 50% of the surface area of the core. More preferably, it may entirely cover the core.

As methods of forming the shell layer, the above double jet method or premix method can be used. It can also be formed by mixing finely particulate silver halide into an emulsion containing the grain that constitutes the core, followed by Ostwald ripening.

In working the present invention, the cores of silver halide grains may be chemically sensitized, or doped with metal ions, or applied with both of them, or applied with none of the both at all.

Employable as the chemical sensitization are sulfur sensitization, gold sensitization, reduction sensitization, noble metal sensitization, and sensitizing methods comprising any combination of these sensitizing methods. Usable as sulfur sensitizers are thiosulfate, thioureas, thiazoles, rhodanines, and other compounds. Such methods are described, for example, in U.S. Pat. Nos. 1,574,944, 1,623,499, 2,410,689 and U.S. Pat. No. 3,656,955.

The cores of the silver halide grains used in working the present invention can be sensitized with a water-soluble gold compound or can be sensitized with use of a reducing sensitizer, as described, for example, in U.S. Pat. Nos, 2,399,083, 2,597,856 and U.S. Pat. No. 2,642,361. As to such methods, reference can be made, for example, on the descriptions in U.S. Pat. Nos. 2,487,850, 2,518,698 and U.S. Pat. No. 2,983,610.

It is further possible &o carry out noble metal sensitization with use of noble metal compounds as exemplified by platinum, iridium and palladium. As to such methods, reference can be made, for example, on the descriptions in U.S. Pat. No. 2,448,060 and British Pat. No. 618,061.

The cores of the silver halide grains can also be doped with metal ions. To dope the cores with metal ions, metal ions can be added, for example, as water-soluble salts of metal ions in any course during which the grains for cores are formed. Preferred examples of the metal ions include metal ions such as iridium, lead, antimony, bismuth, gold, osmium and rhodium. These metal ions may preferably used in a concentration of $1 \times 10^{-3}$ to $1 \times 10^{-4}$ mol per mol of silver.

Provided that those used as the cores of silver halide grains may not be subjected to the above chemical sensitization treatments or doping with metal ions. In such instances, sensitivity centers are presumed to be produced by, e.g., forming crystal distortion at the interface between the core and shell layer in the course of covering the grains of cores with the shell layers. In relation thereto, reference can be made on the descriptions in U.S. Pat. Nos. 3,935,014 and 3,957,488.

The silver halide emulsion used in the present invention can be chemically sensitized by commonly available methods at any stages during preparation. The silver halide grains of the present invention can further occlude polyvalent metal ions in the insides of grains. preferred examples of the polyvalent metal ions include metal ions such as iridium, lead, antimony, bismuth, gold, platinum, osmium and rhodium.

The silver halide grains according to the present invention may preferably be not chemically sensitized on the grains surfaces, or, if sensitized, sensitized to a slight degree.

In the direct-positive silver halide photographic light-sensitive material of the present invention, internal latent image silver halide grains not previously fogged on the surfaces can be used. Here, what is meant bV the internal latent image silver halide grains not previously fogged on the surfaces is that the density obtained when test pieces comprising transparent film supports coated with the above emulsion to a thickness of mgAg/cm$^2$ were developed at 20° C. for 10 minutes without exposure to light, using the following surface developing solution A, is not more than 0.6, and preferably not more than 0.4.

| | |
|---|---|
| Metol | 2.5 g |
| l-Ascorbic acid | 10 g |
| $NaBO_2.4H_2O$ | 35 g |
| KBr | 1 g |
| Made up by adding water, to | 1 l |

The emulsion containing the silver halide grains ording to the present invention can give a sufficient density when a test piece prepared in the following manner was exposed to light and thereafter developed with an internal developing solution B having the following recipe.

| | |
|---|---|
| Metol | 2 g |
| Sodium sulfite (anhydrous) | 90 g |
| Hydroquinone | 8 g |
| Sodium carbonate (monohydrate) | 52.5 g |
| KBr | 5 g |
| KI | 0.5 g |
| Made up by adding water, to | 1 l |

To describe in a further specific way, when a part of the above test pieces is exposed to light to a light intensity scale over a given time not exceeding about 1 second and developed at 20° C. for 10 minutes using the internal developing solution B, shown is a maximum density at least 5 times, and preferably at least 10 times, greater than the density obtained when another part of the test pieces, exposed to light under the same conditions, was developed at 20° C. for 10 minutes using the surface developing solution A.

In the processing method of the present invention, the light-sensitive material is developed in the presence of a fogging agent.

The developing solutions used here may preferably contain a phosphoric acid compound.

Any compounds can be used as the phosphoric acid compound, typically including phosphoric acid, orthophosphoric acid, all sorts of polyphosphoric acids, and derivatives such as salts of these. More specifically, usable phosphoric acid compounds include those represented by the following Formula (P-I), (P-II) or (P-III).

$A^1{}_mP_mO_{3m}$ Formula (P-I)

$A^2,A^3,A^4{}_nP_nO_{3n+1}$ Formula (P-II)

$A^5,A^6,A^7PO_3$ Formula (P III)

wherein, $A^1$ to $A^7$ each represent a hydrogen atom, an alkali metal atom or an alkyl group; and m and n each represent an integer of 1 to 20.

Of the phosphoric acid compounds represented by Formula (P-I), (P-II) or (P-III), preferably used in the present invention are the compounds represented by any of the following Formulas (P-IV) to (P-XI).

$M_mP_mO_{3m}$ Formula (P-IV)

$M_{n+2}P_nO_{3n+1}$ Formula (P-V)

wherein M represents a hydrogen atom or an alkali metal atom; and m and n each represent an integer of 1 to 20.

$B_1—R_{21}—Z—R_{22}—COOH$ Formula (P-IV)

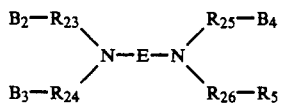

Formula (P-VII)

wherein E represents a substituted or unsubstituted alkylene group, a cycloalkylene group, a phenylene group, $—R_{27}—$, $—OR_{27}—$, $—R_{27}—OR_{27}—$ or $R_{27}ZR_{27}—$; Z represents $>N—R_{27}—B_6$ or $>N—B_6$; $R_{21}$ to $R_{27}$ each represent a substituted or unsubstituted alkylene group,; $B_1$ to $B_6$ each represent a hydrogen atom, —OH, —COOM, $—PO_3M_2$, where at least one of $B_1$ and $B_6$ represents $—PO_3M_2$, at least one of $B_2$ to $B_5$ represents $PO_3M_2$; and M represents a hydrogen atom or an alkali metal atom.

$R_{28}N(CH_2PO_3M_2)_2$ Formula (P-VIII)

wherein $R_{28}$ represents a lower alkyl group, an aryl group, an aralkyl group, a nitrogen-containing 6-membered ring group (having —OH, —OP or —COOM as a substitutent); and M represents a hydrogen atom or an alkali metal atom.

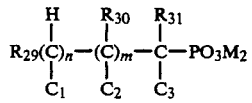

Formula (P-IX)

wherein $R_{29}$ to $R_{31}$ each represent a hydrogen atom, —OH, a lower alkyl group which is unsubstituted, or having —OH, —COOM or $—PO_3M_2$ as a substitutent; $C_1$ to $C_3$ each represent a hydrogen atom, —OH, —COOM, $—PO_3M_2$ or $—Nj_2$, where j represents a hydrogen atom, a lower alkyl group, $C_2H_4OH$ or $—PO_3M_2$; M represents a hydrogen atom or an alkali metal atom; and n and m each represent 0 or 1.

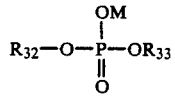

Formula (P-X)

wherein $R_{32}$ and $R_{33}$ each represent a hydrogen atom, an alkyl group having 1to 12 carbon atoms, an alkenyl group or a cyclic alkyl group; and M represents a hydrogen atom or an alkali metal atom.

Formula (P-XI)

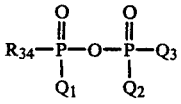

wherein $R_{34}$ represents an alkyl group having 1 to 12 carbon atoms, an alkoxy group having 1 to 12 carbon atoms, a monoalkylamino group having 1 to 12 carbon atoms, a dialkylamino group having 1 to 12 carbon atoms, an amino group, an aryloxy group having 1 to 24 carbon atoms, an arylamino group having 6 to 24 carbon atoms or an amyloxy group; $Q_1$ to $Q_3$ each represent —OH, an alkoxy group having 1 to 24 carbon atoms, an aralkyloxy group, an aryloxy group, —$OM_3$ (M is a cation), an amino group a morpholino group, a oyolic amino group, an alkylamino group, a dialkylamino group, an arylamino group or an alkyloxy group.

Typical examples of the phosphoric acid compounds represented by the above formulas are shown below.

$Na_4P_4O_{12}$ (P-1)
$Na_3P_3O_4$ (P-2)
$H_4P_2O_7$ (P-3)
$H_5P_3O_{10}$ (P-4)
$Na_4P_4O_{13}$ (P-5)
$H_3PO_4$ (P-6)
$Na_2PO_4$ (P-7)
$H_3PO_4$ (P-8)
$H_3PO_3$ (P-9)
$PO(OC_2H_5)(OH)_2$ (P-10)
$Na_2HPO_3$ (P-11)
$(NH_4PO_3)_{10}$ (P-12)
$(NH_4PO_3)_5$ (P-13)
$H_5P_3O_{10}$ (P-14)

(P-15)

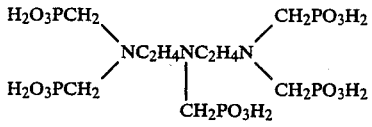

(P-16)

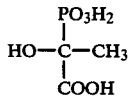

(P-17)

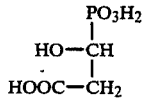

(P-18)

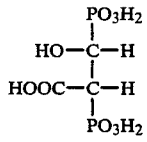

(P-19)

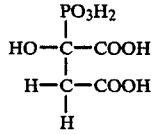

-continued (P-20)

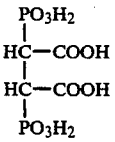

(P-21)

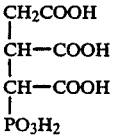

(P-22)

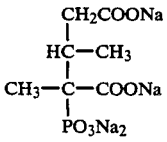

(P-23)

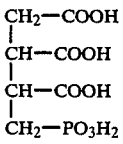

(P-24)

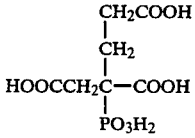

(P-25)

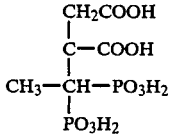

(P-26)

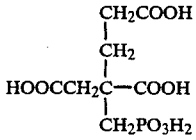

(P-27)

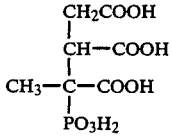

(P-28)

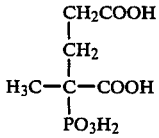

(P-29)

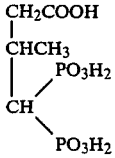

(P-30)

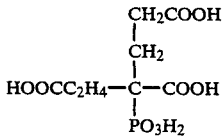

-continued
(P-31)
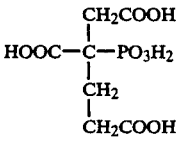
(P-32)
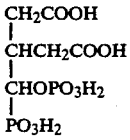
(P-33)
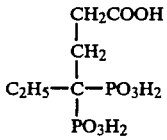
(P-34)
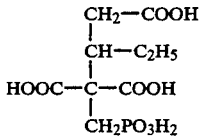
(P-35)
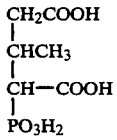
(P-36)
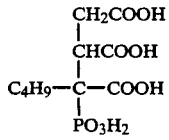
(P-37)
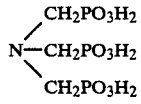
(P-38)
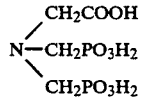
(P-39)
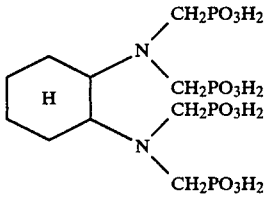
(P-40)
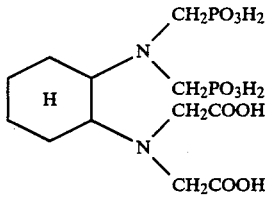
-continued
(P-41)
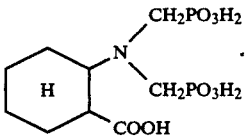
(P-42)
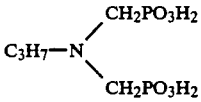
(P-43)
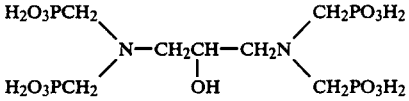
(P-44)
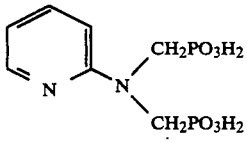
(P-45)
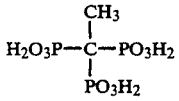
(P-46)
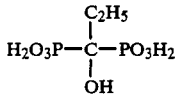
(P-47)
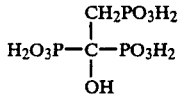
(P-48)
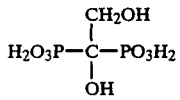
(P-49)
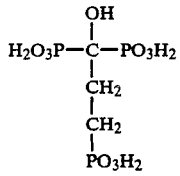
(P-50)
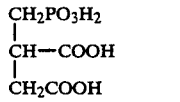
(P-51)
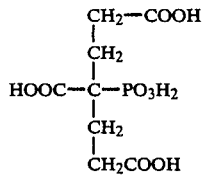
(P-52)
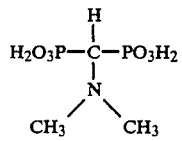

-continued

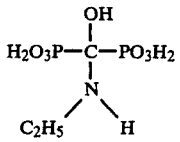

(P-53)

The above phosphoric acid compounds may preferably be used in an amount of from 3 g to 200 g, and more preferably from 5 g to 10 g, per liter of the developing solution. In the present invention, it is preferred to use a developing solution with the pH of 9.5 to 12.0.

In the processing method used in the present invention, the color developing solution may preferably contain substantially no hydroxylamine except derivatives thereof.

Incorporation of a hydroxylamine derivative represented by the following Formula (HA) into the developing solution used in the present invention can bring about not only a better exhibition of the effect aimed in the present invention but also a low suppressed fog density at unexposed portions of light-sensitive materials. Accordingly, this may preferably be used in combination in the present invention.

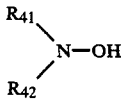

Formula (HA)

In the formula $R_{41}$ and $R_{42}$ each represent an alkyl group or a hydrogen atom. Provided that both $R_{41}$ and $R_{42}$ are not hydrogen atoms at the same time. $R_{41}$ and $R_{42}$ may also combine to form a ring.

In (HA), $R_{41}$ and $R_{42}$ each represent an alkyl group or a hydrogen atom, which are not hydrogen atoms at the same time, but the alkyl groups represented by $R_{41}$ and $R_{42}$ may be the same or different, and may preferably each represent an alkyl group having 1 to 3 carbon atoms. The alkyl groups represented by $R_{41}$ and $R_{42}$ includes those having a substituent, and $R_{41}$ and $R_{42}$ may combine to constitute a ring. for example, may constitute a heterocyclic ring such as piperidine or morphorine.

Specific compounds of the hydroxylamine derivative represented by Formula (HA) are described in U.S. Pat. Nos. 3,287,125, 3,293,034, U.S. Pat. No. 3,287,124 and so forth, but particularly preferred exemplary compounds are shown below.

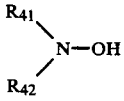

| Exemplary Compound No. | $R_{41}$ | $R_{42}$ |
|---|---|---|
| A-1 | $-C_2H_5$ | $-C_2H_5$ |
| A-2 | $-CH_3$ | $-CH_3$ |
| A-3 | $-C_3H_7(n)$ | $-C_3H_7(n)$ |
| A-4 | $-C_3H_7(i)$ | $-C_3H_7(i)$ |
| A-5 | $-CH_3$ | $-C_2H_5$ |
| A-6 | $-C_2H_5$ | $-C_3H_7(i)$ |
| A-7 | $-CH_3$ | $-C_3H_7(i)$ |
| A-8 | $-H$ | $-C_2H_5$ |
| A-9 | $-H$ | $-C_3H_7(n)$ |
| A-10 | $-H$ | $-CH_3$ |

-continued

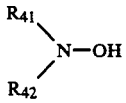

| Exemplary Compound No. | | |
|---|---|---|
| A-11 | $-H$ | $-C_3H_7(i)$ |
| A-12 | $-C_2H_5$ | $-C_2H_4OCH_3$ |
| A-13 | $-C_2H_4OH$ | $-C_2H_4OH$ |
| A-14 | $-C_2H_4SO_3H$ | $-C_2H_5$ |
| A-15 | $-C_2H_4COOH$ | $-C_2H_4COOH$ |
| A-16 | 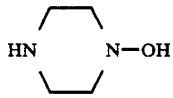 | |
| A-17 | 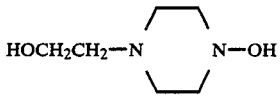 | |
| A-18 | 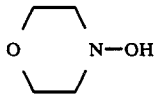 | |
| A-19 | 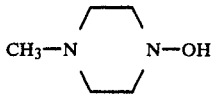 | |
| | $R_{41}$ | $R_{42}$ |
| A-20 | $-CH_3$ | $-C_2H_4OCH_3$ |
| A-21 | $-C_2H_4OCH_3$ | $-C_2H_4OCH_3$ |
| A-22 | $-C_2H_4OC_2H_5$ | $-C_2H_4OC_2H_5$ |
| A-23 | $-C_3H_6OCH_3$ | $-C_3H_6OCH_3$ |
| A-24 | $-C_2H_5$ | $-C_2H_4OC_2H_5$ |
| A-25 | $-C_3H_7$ | $-C_2H_4OCH_3$ |
| A-26 | $-CH_3$ | $-C_2H_4OC_2H_5$ |
| A-27 | $-CH_3$ | $-CH_2OCH_3$ |
| A-28 | $-C_2H_5$ | $-CH_2OC_2H_5$ |
| A-29 | $-CH_2OCH_3$ | $-CH_2OCH_3$ |
| A-30 | $-C_2H_5$ | $-C_2H_4OC_3H_7$ |
| A-31 | $-C_3H_6OC_3H_7$ | $-C_3H_6OC_3H_7$ |

These compounds are usually used in the form of hydrochloride, sulfate, p-toluenesulfonate, oxalate, phosphate or acetate, or in the free form.

The compound represented by Formula (HA) of the present invention is contained in the color developing solution in a concentration of usually from 0.2 g/l to 50 g/l, preferably from 0.5 g/l to 30 g/l, and more preferably from 1 g/l to 15 g/l.

The compound represented by Formula (HA) may also be used alone or in combination of two or more types.

The direct-positive silver halide photographic light-sensitive material of the present invention may preferably contain a compound represented by the following Formula (HQ) in any layer of hydrophilic colloid layers.

This Formula (HQ) is as shown below.

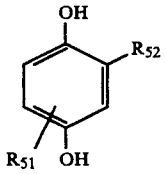

In Formula (HQ), $R_{51}$ and $R_{52}$ each represent a hydrogen atom or an alkyl group, and each alkyl group of $R_{51}$ and $R_{52}$ has the carbon atom number of not more than 5.

Specifically, the compounds shown in the following (A) to (H) are preferred as the compound represented by Formula (HQ). Provided that those which can be used in the present invention are by no means particularly limited to these compounds (Examples of compounds)

(A)

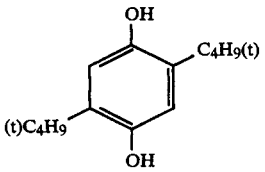

(B)

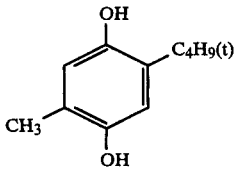

(C)

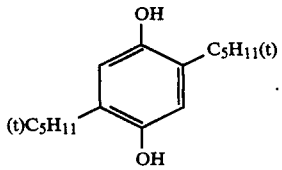

(D)

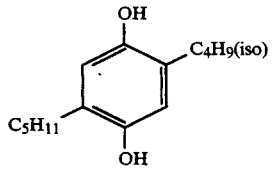

(E)

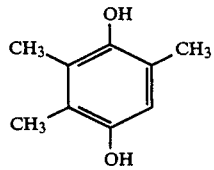

(F)

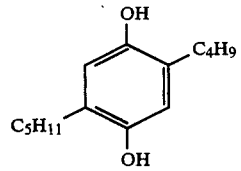

-continued (Examples of compounds)

(G)

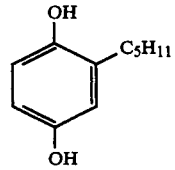

(H)

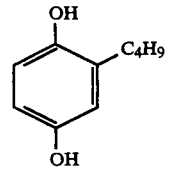

The amount of this compound to be added in at least any one layer of the photographic component layers may preferably range from 0.001 to 0.50 g/m$^2$, and more preferably from 0.005 to 0.20 g/m$^2$. Also, the above compounds may be used alone or may be mixed by arbitrarily selecting two or more compounds. It is also possible to use a quinone derivative having not less than 5 carbon atoms by adding it to the compound represented by the above Formula (HA), so long as the effect of the present invention may not be impaired. In either case of these, the amount of the compound to be used even as a mixture may preferably range from 0.001 to 0.50 g/m$^2$.

The silver halide emulsion can be optically sensitized using sensitizing dyes commonly used. Combination of sensitizing dyes used in supersensitization of internal latent image silver halide emulsions, negative silver halide emulsions, etc. is also useful for the silver halide emulsion of the present invention. As to the sensitizing dyes, reference can be made on Research Disclosures No., 15162 and No. 17643.

In instances in which direct-positive images are obtained by using the direct-positive silver halide photographic light-sensitive material of the present invention, the direct positive images can be readily obtained by carrying out imagewise exposure (the so-called photographying, i.e., exposing a light-sensitive material to light to form an image) according to a usual method, followed by surface development. More specifically, formation of the direct-positive images mainly comprises the steps of subjecting a photographic material having an internal latent image silver halide emulsion layer to imagewise exposure, and thereafter applying a treatment to form fog nuclei (hereinafter "fogging treatment") by a chemical action followed by surface development, or thereafter carrying out surface development while applying fogging treatment. Here, the fogging treatment can be carried out by use of a compound that forms fog nuclei (hereinafter "fogging agent").

Compounds of wide-ranging types can be used as the fogging agent used in the present invention, and this fogging agent may be satisfactory if it is present at the time of developing. For example, it may be contained in component layers other than a support of a light-sensitive material, preferably in silver halide emulsion layers in particular, or in a developing solution or a processing solution preceding the developing. It can also be used in an amount that may vary in a wide range depending on purposes, and may preferably be added in an amount of from 1 to 1,500mg, and preferably from 10 to ,1,000 mg, per mol of silver halide when it is added in the silver halide emulsion layers. When it is added in the processing solution such as the developing solution, it may also be added in an amount of from 0.01 to 5 g/l, and particularly preferably from 0.05 to 1 g/l.

The fogging agent used in the present invention includes compounds having a group that adsorbs on a silver halide surface, as exemplified by hydrazines, as described in U.S. Pat. Nos. 2,563,785 and 2,588,982, or hydrazides or hydrazine compounds, as described in U.S. Pat. No. 3.227,552; salts of heterocyclic quaternary nitrogen compounds, as described in U.S. Pat. Nos. 3,615,615, 3,718,470, 3,719,494, 3,734,738 and 3,759,901; and also acylhydrazinophenylthio ureas, as described in U.S. Pat. No. 4,030925. These fogging agents can also be used in combination. For example, Research Disclosure No 15162 discloses that a non-adsorptive fogging agent is used in combination with an adsorptive fogging agent.

As the fogging agent used in the present invention, either adsorptive ones or non-adsorptive ones can be used, and they can also be used in combination.

To set out useful examples of the fogging agent, they include hydrazine compounds such as hydrazine hydroohloride, phenylhydrazine hydrochloride, 4-methylphenylhydrazine hydrochloride 1-formyl-2-(4-methylphenyl)hydrazine, 1-acetyl-2-phenYlhydrazine, 1-acetyl-2-(4-acetamidophenyl)hydrazine. 1-methylsulfonyl-2-phenylhydrazine, 1-benzoyl-2-phenylhydrazine. 1-methylsulfonyl-2-(3-phenylsulfonamidophenyl)hydrazine, and formaldehyde phenylhydrazine; N-substituted quaternary cycloammonium salts such as 3-(2-formylethyl)-2-methylbenzothiazolium bromide, 3-(2-formylethyl)-2-propylbenzothiazolium bromide, 3-(2-acetylethyl)-2-benzylbenzoselenazolium bromide, 3-(2-acetylethyl)-2-benzyl-5-phenyl-benzoxazolium bromide, 2-methyl-3-[3-(phenylhydrazono)propyl]benzothiazolium bromide, 2-methyl-3-[3-(p-tolylhydrazono)propyl]benzothiazolium bromide 2-methyl-3-[3 (p-sulfophenylhydrazono)propyl]benzothiazolium bromide, 2 methYl-3 [3-(p-sulfophenylhydrazono)pentyl]benzothiazolium iodide, 1,2-dihydro-3-methyl-4-phenylpyrido[2,1-b]benzothiazolium bromide, 1,2-dihydro-3-methyl-4-phenylpyrido[2,1-b]-5-phenylbenzoxazolium bromide, 4,4'-ethylene-bis(1,2-dihydro-3-methylpyrido[2,1-b]benzothiazolium bromide, and 1,2-dihydro-3-methyl-4-phenylpyrido[2,1-b]benzoselenazolium bromide; 5-[(1-ethylnaphtho(1,2-b)thiazolin-2-ylideneethylidene]-1-(2-phenylcarbazoyl)methyl-3-(4-sulfamoylphenyl)-2-thiohydantoin, 5-(3-ethyl-2-benzothiazolinylidene)-3-[4-(2-formylhydrozino)phenyl]rhodanine, 1-[4-(2-formylhydrazino)phenyl]-3-phenylthiourea, and 1,3-bis [4-(2-formylhydrazino)phenyl]thiourea.

The direct-positive silver halide photographic light-sensitive material of the present invention is subjected to developing in the presence of the fogging agent after imagewise exposure to light to form the direct-positive image. Any desired developing is employed as the developing method of the direct-positive light-sensitive material according to the present invention, but preferably a surface developing method may be used. This surface developing method is meant by the processing carried out with use of a developing solution substantially containing no silver halide solvent.

Developing agents that can be used in the developing solution used in the development of the direct-positive light sensitive material according to the present invention include commonly available silver halide developing agents, as exemplified by polyhydroxybenzenes such as hydroquinone, aminophenols, 3-pyrazolidones, ascorbic acid and derivatives thereof, reductones, phenylenediamines, or a mixture of any of these. They specifically include hydroquinone, aminophenol, N-methylaminophenol, 1-phenyl-3-pyrazolidone, 1-phenyl-4,4-dimethyl-3-pyrazolidone, 1-phenyl-4-methyl-4-hydroxymethyl-3-pyrazolidone, ascorbic acid, N,N-diethyl-p-phenylenediamine. diethylamino-o-toluidine, 4-amino-3-methyl-N-ethyl-N-(β-methanesulfonamidoethyl)aniline, and 4-amino-3-methyl-N-ethyl-N-(β-hydroxyethyl)aniline. These developing agents can be previously contained in emulsions so that they may act on silver halide during immersion in an aqueous high-pH solution.

The developing solution used in the present invention may further contain a specific antifogging agent and a development restrainer, or it is also possible to optionally incorporate these developing solution additives into component layers of the ligh&-sensitive material. Usually useful antifogging agents include heterocyclic thiones or aromatic and aliphatic mercapto compounds such as benzotriazoles, as exemplified by 5-methylbenzotriazole, benzoimidazoles, benzothiazoles, benzoxazoles, and 1-phenyl-5-meroaptotetrazole. The developing solution may also contain a development accelerator as exemplified by polyalkylene oxide derivatives or quaternary ammonium salt compounds.

In the direct-positive light-sensitive material also, it is common, after developing of the silver halide light-sensitive material in general, to carry out fixing or bleach-fixing, such that fixing is carried out with use of a processing solution containing a silver halide solvent, in order to remove unnecessary silver halide, or, in instances in which color images are obtained by developing, bleach-fixing is carried out with use of a processing solution containing a silver halide solvent and an oxidant, in order to remove unnecessary silver halide and metallic silver formed by development. In instances where photographic light-sensitive materials on which, after developing, the fixing or bleach-fixing can be directly carried out through no washing or no stopping using an acidic bath are used to make rapid the processing, the minimum density of an image can be small suppressed and thus an image with good quality can be obtained.

It is a matter of option to add various photographic additives in the emulsion containing the silver halide grains according to the present invention.

Other additives that are used in the present invention depending on purposes are wetting agents including, for example, dihydroxyalkane film property improving agents suitably including, for example, water-dispersible finely particulate polymeric materials obtained by emulsion polymerization, such as a copolymer of alkyl acrylate or alkyl methacrylate with acrylic acid or methacrylic acid, a styrene/maleic acid copolymer, and a styrene/maleic anhydride/half alkyl ester copolymer; coating aids including saponin, and polyethylene glycol lauryl ether. It is also a matter of option to use other photographic additives including gelatin plasticizers, surface active agents. ultraviolet absorbents, pH adjusters, antioxidants, antistatic agents, thickening agents, graininess improving agents, dyes, mordants, brightening agents, development speed regulators, and matting agents.

The silver halide emulsions prepared as described above are coated on a support optionally interposing subbing layers, halation-preventive layers and filter layers, to obtain the internal latent image silver halide photographic light-sensitive material.

It is useful to apply the direct-positive silver halide photographic light-sensitive material according to the present invention in color photography. In this instance, cyan, magenta and yellow dye image-forming couplers may preferably contained in the silver halide emulsion. Those commonly used can be used as the couplers.

It is also useful to use ultraviolet absorbents as exemplified by thiazolidone, benzotriazole, acrylonitrile or benzophenone compounds to prevent the browning of dye images which is due to active light rays having short wavelengths, and particularly useful is to use alone or in combination Tinubin-PS, -320, -326, -327 and -328 (all available from Chiba-Geigy Corp.)

As the support, any desired supports can be used, but typical supports include polyetheylene terephthalate film, polycarbonate film, polystyrene film, polypropylene film, cellulose acetate film, glass, baryta paper, and polyethylene-laminated paper, which have been optionally subjected to subbing.

In the emulsion containing the silver halide grains according to the present invention, gelatin, and besides, suitable gelatin derivatives can be used as protective colloids or binding materials depending on purposes. The present suitable gelatin derivatives may include, for example, acylated gelatin, guanidylated gelatin, carbamylated gelatin, cyanoethanolated gelatin, and esterified gelatin.

In the present invention, it is also possible to contain other hydrophilic binding material depending on purposes, and suitable binding materials include gelatin, and besides, colloidal albumin, agar, gum arabic, dextran, alginic acid, cellulose derivatives such as cellulose acetate having been hydrolized to an acetyl content of 19% to 20%, polyacrylamide, imidized polyacrylamide, casein, vinyl alcohol polymers containing a urethane carboxylic acid group or cyanoacetyl group, such as vinyl alcohol/vinyl aminoacetate copolymer; polyvinyl alcohol, polyvinyl pyrrolidone, hydrolyzed polyvinyl acetate, polymers obtained by polymerization of a protein or saturated acylated protein with a monomer having a vinyl group, polyvinylpyridine, polyvinylamine, polyaminoethyl methacrylate, and polyethyleneamine, which can be added to photographic component layers such as emulsion layers, intermediate layers, protective layers, filter layers and backing layers depending on purposes. A suitable plasticizer, lubricant or the like can be further contained in the above hydrophilic binders depending on purposes.

The component layers of the direct-positive light-sensitive material according to the present invention can be hardened using any desired suitable hardening agents. These hardening agents include chromium salts, zirconium compounds, and aldehyde (for example, formaldehyde or muchohalogen acid), halotriazine polyepoxy, compound, ethyleneimine, vinylsulfone or acryloyl hardening agents.

It is also possible for the photographic light-sensitive material according to the present invention to be provided on its support with a number of various photographic component layers such as emulsion layers, filter layers, intermediate layers, protective layers, subbing layers, backing layers, and halation preventive layers.

EXAMPLES

The present invention will be described below in a specific manner by giving Examples, but is by no means limited to these.

EXAMPLE 1

(Preparation of Em-1)

A monodisperse silver chlorobromide emulsion Em-1 was prepared in the following manner.

While controlling to 40° C. an aqueous solution containing (i) a seed emulsion comprising ossein gelatin and silver bromide of 0.11 μm in average grain size and (ii) ammonia, an aqueous solution containing ammonia and silver nitrate and an aqueous solution containing potassium bromide were simultaneously added in the first-mentioned solution according to a controlled double jet method to obtain silver bromide core grains having an average grain size of 0.15 μm. The rate of addition at this time gas made to be a rate of 70% of the maximum addition rate at which any new silver halides are not produced. In that occasion, the pH and pAg of the emulsion in the course of addition were so controlled that grains having a grain form of a cube can be obtained, using an aqueous solution containing potassium bromide and an aqueous solution containing acetic acid.

To the resulting silver bromide emulsion of 0.15 μm, an aqueous solution containing ammonia and silver nitrate and an aqueous solution containing potassium bromide and sodium chloride (KBr:NaCl=50:50 in molar ratio) were further simultaneously added according to the controlled double jet method, and shells were formed until the average grain size came to be 0.215 μm. The rate of addition at this time was made to be a rate of 50% of the maximum addition rate at which any new silver halides are not produced. In that occasion, the pH and pAg of the emulsion in the course of addition were so controlled that grains having a cubic grain form can be obtained, using an aqueous solution containing potassium bromide and sodium chloride (KBr:NaCl=50:50 in molar ratio) and an aqueous solution containing acetic acid. Subsequently, washing was carried out to remove water-soluble salts, followed by addition of gelatin, thus making the emulsion Em-1. Electron-microscopic observation confirmed that this emulsion had a cubic grain form and a monodisperse emulsion having uniform grain size.

(Preparation of Em-2 to Em-7)

Monodisperse silver chlorobromide emulsions Em-2 to Em-7 were prepared in the same manner as the preparation of Em-1.

Provided that each emulsion was prepared under conditions described in Table 1 in regard to the grain size of seed emulsions, grain size of silver bromide core grains, and final grain size after formation of shells. Electron-microscopic observation confirmed that the resulting emulsions Em-2 to EM-7 had a cubic grain form and monodisperse emulsions having uniform grain size.

TABLE 1

| | Average grain size (μm) | | |
|---|---|---|---|
| | Silver bromide seed emulsion | Silver bromide core grains | Final grain size |
| Em-1 | 0.11 | 0.15 | 0.215 |
| Em-2 | 0.11 | 0.18 | 0.272 |
| Em-3 | 0.11 | 0.22 | 0.329 |

TABLE 1-continued

| | Average grain size (μm) | | |
|---|---|---|---|
| | Silver bromide seed emulsion | Silver bromide core grains | Final grain size |
| Em-4 | 0.11 | 0.30 | 0.443 |
| Em-5 | 0.26 | 0.41 | 0.602 |
| Em-6 | 0.26 | 0.55 | 0.817 |
| Em-7 | 0.26 | 0.75 | 1.14 |

(Preparation of Em-8)

A polydisperse silver chlorobromide emulsion Em-8 was prepared in the following manner.

While controlling to 60° C. an aqueous solution containing ossein gelatin and 0.75 mol of potassium bromide, an aqueous solution containing 0.7 mol of silver nitrate was added over a period of 40 minutes to obtain polydisperse silver bromide. Subsequently, in the solution containing the polydisperse silver bromide, an aqueous solution containing 0.53 mol of sodium chloride and 0.32 mol of potassium bromide and an aqueous solution containing 0.8 mol of silver nitrate were simultaneously added over a period of 20 minutes. After the addition was completed, washing was carried out to remove water-soluble salts, followed by addition of gelatin, thus making the emulsion Em-8 (average grain size: 0.33 μm).

Electron-microscopic observation confirmed that this emulsion is a polydisperse silver ohlorobromide emulsion. Also this emulsion is a polydisperse emulsion having one broad peak in the grain size distribution curve.

Next, sensitizing dye shown below as GD-1 was added in emulsions Em-1 to Em-8 to obtain green-sensitive emulsions Em-1 to Em-8.

Using the resulting green-sensitive emulsions Em-1 Em-8, Sample No. 1 was prepared in the following way.

On a double-sided polyethylene laminate paper, a first layer to an eighth layer were provided by coating as shown in Table 2. SA-1 and SA-2 were used as coating aids, and HA-1 and HA-2 were used as hardening agents to carry out the coating.

TABLE 2

| Sample No. 1: (Numerals indicate coating weight; unit: mg/dm²) | |
|---|---|
| Sixth layer (ultraviolet-absorbing layer) | |
| Ultraviolet absorbent (UV-1) | 0.65 |
| Ultraviolet absorbent (UV-2) | 1.95 |
| Solvent (SO-3) | 1.0 |
| Gelatin | 7.8 |
| Colloidal silica | 0.07 |
| Fifth layer (blue-sensitive emulsion layer) | |
| Silver chlorobromide emulsion (average grain size: 0.88 μm) | 4.4* |

TABLE 2-continued

| Sample No. 1: (Numerals indicate coating weight; unit: mg/dm²) | |
|---|---|
| Silver chlorobromide emulsion (average grain size: 0.44 μm) | 1.2* |
| Blue-sensitive sensitizing dye (BD-1) | |
| Fogging agent (FA-1) | $5.5 \times 10^{-5}$ mol/mol Ag |
| Yellow coupler (YC-1) | 8.2 |
| Image stabilizer (AO-3) | 3.0 |
| Anti-stain agent (AS-1) | 0.25 |
| Anti-stain agent (AS-2) | 0.25 |
| Solvent (SO-1) | 5.2 |
| Gelatin | 14.3 |
| Fourth layer (yellow colloidal layer) | |
| Yellow colloidal silver | 1.05 |
| Color-mixing preventive agent (AS-1) | 0.40 |
| Solvent (SO-2) | 0.49 |
| Polyvinyl pyrrolidone | 0.47 |
| Gelatin | 4.2 |
| Third layer (green-sensitive emulsion layer) | |
| Silver bromide emulsion (Em-2) | 1.30* |
| Silver bromide emulsion (Em-4) | 2.00* |
| Green-sensitive sensitizing dye (GD-1) | |
| Fogging agent (FA-1) | $5.5 \times 10^{-5}$ mol/mol Ag |
| Magenta coupler (MC-1) | 2.4 |
| Image stabilizer (AO-1) | 2.2 |
| Image stabilizer (AO-2) | 1.55 |
| Anti-stain agent (AS-1) | 0.03 |
| Anti-stain agent (AS-2) | 0.19 |
| Solvent (SO-4) | 3.15 |
| Anti-irradiation dye (AI-1) | 0.13 |
| Gelatin | 13.0 |
| Second layer (intermediate layer) | |
| Color-mixing preventive agent (AS-1) | 0.55 |
| Solvent (SO-2) | 0.72 |
| Gelatin | 7.5 |
| First layer (red-sensitive emulsion layer) | |
| Silver chlorobromide emulsion (average grain size: 0.62 μm) | 2.08* |
| Silver chlorobromide emulsion (average grain size: 0.22 μm) | 0.70* |
| Silver chlorobromide emulsion (average grain size: 0.20 μm) | 0.50* |
| Red-sensitive sensitizing dye (RD-1), (RD-2) | |
| Fogging agent (FA-1) | $5.5 \times 10^{-5}$ mol/mol Ag |
| Cyan coupler (CC-1) | 2.08 |
| Cyan coupler (CC-2) | 2.08 |
| Image stabilizer (AO-3) | 2.2 |
| Anti-stain agent (AS-2) | 0.15 |
| Solvent (SO-1) | 3.3 |
| Anti-irradiation dye (AI-2) | 0.09 |
| Gelatin | 13.8 |
| Support | |
| Paper support laminated with polyethylene on its both sides; thickness: | 140 μm |
| Back coating | |
| Gelatin | 53 |
| Colloidal silica | 6.0 |

*Coating weight is in terms of silver.

RD-1

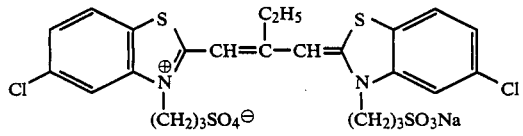

-continued
RD-2
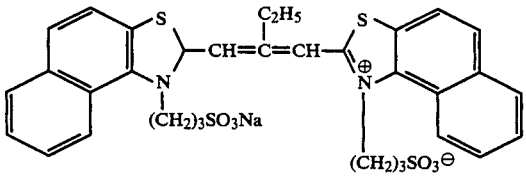
GD-1
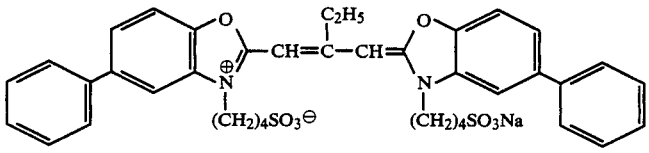
BD-1
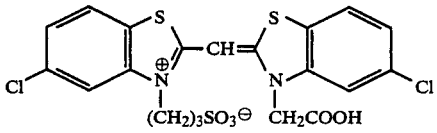
F-1
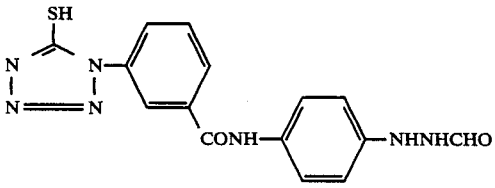
CC-1
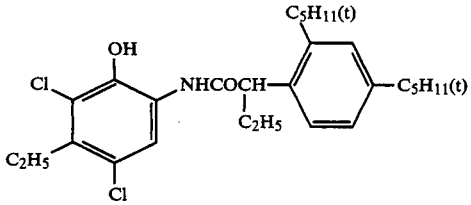
CC-2
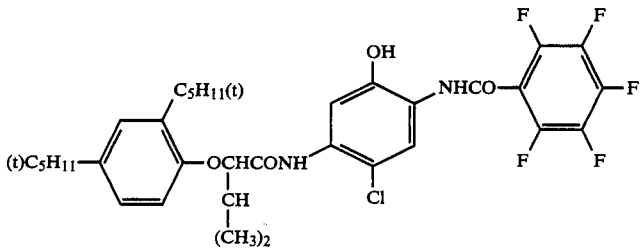
MC-1
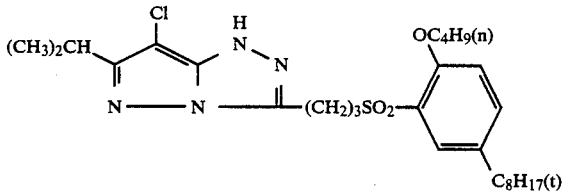

-continued
MC-2
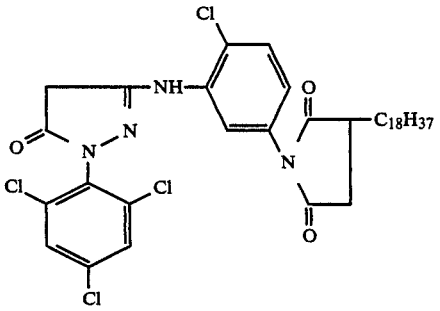
YC-1
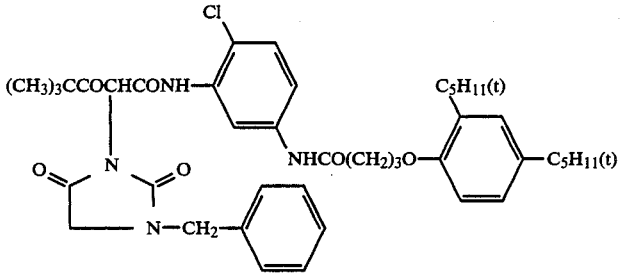
SO-1
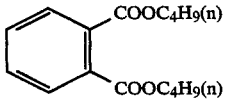
SO-2
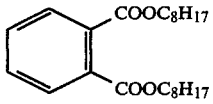
SO-3
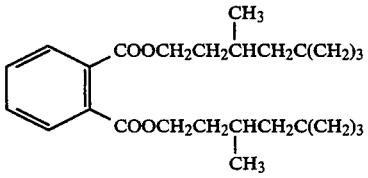
SO-4
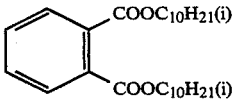
AS-1
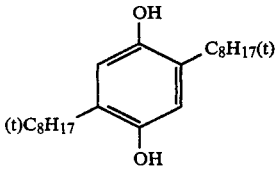
AS-2
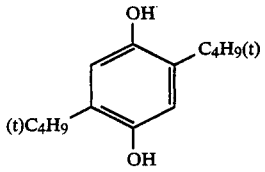
AO-1
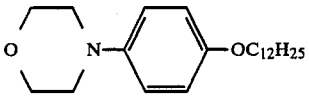

-continued
AO-2
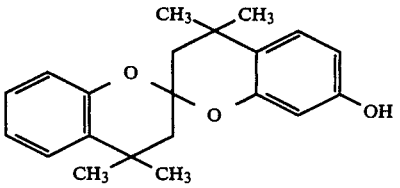
AO-3
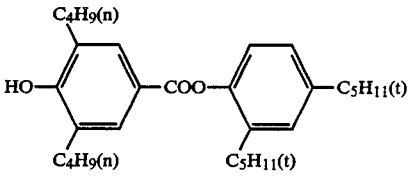
HA-1
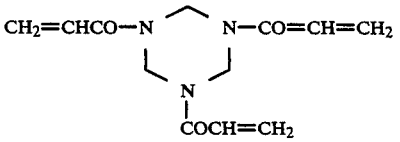
HA-2
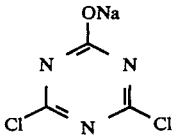
UV-1
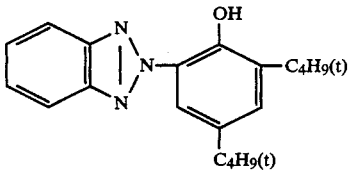
UV-2
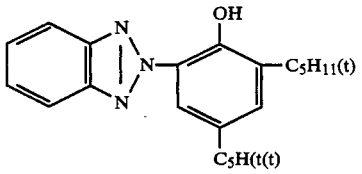
SA-1
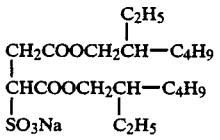
SA-2
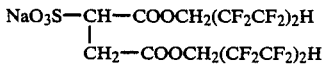
AI-1
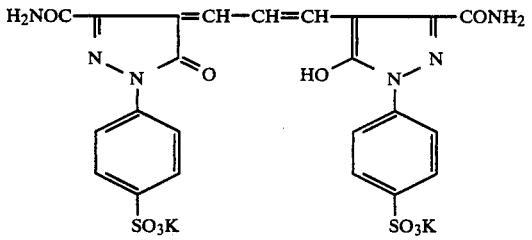

-continued

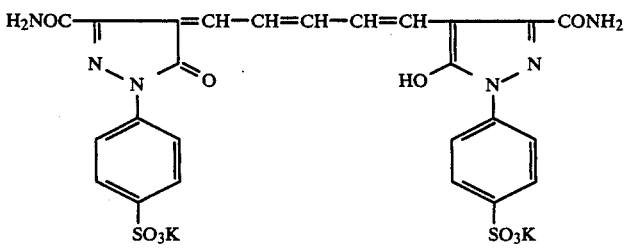

AI-2

Samples No. 2 to No. 10 were prepared in the same manner as Sample No. 1.

Provided that in the composition of the third layer (green-sensitive emulsion layer) in Sample No. 1, emulsions and magenta couplers were varied as shown in Table 3.

Further, Sample No. 11 was prepared in the same manner as Sample No. 1, except that Third layer-A and Third layer-B were provided in place of Third layer. Compositions of Third layer-A and Third layer-B were as follows:

| | Third layer-B | Third layer-A |
|---|---|---|
| Silver chlorobromide emulsion | Em-4 2.00* | Em-2 1.30* |
| Green-sensitizing dye | GD-1 | GD-1 |
| Fogging agent (EA-1) mol/mol Ag | $5.5 \times 10^{-5}$ | $5.5 \times 10^{-5}$ |
| Magenta coupler (No. 10) | 1.44 | 0.96 |
| Image stabilizer (AO-1) | 1.32 | 0.88 |
| Image stabilizer (AO-2) | 0.75 | 0.50 |
| Anti-stain agent (AS-1) | 0.018 | 0.012 |
| Anti-stain agent (AS-2) | 0.114 | 0.076 |
| Solvent SO-4 | 0.078 | 0.052 |
| Gelatin | 7.8 | 5.2 |

TABLE 3

| Sample No. | Emulsion | Magenta coupler | Remarks |
|---|---|---|---|
| 1 | Em-2 (1.30), Em-4 (2.00) | Comp. No. 10 (2.4) | Y |
| 2 | Em-1 (1.30), Em-3 (2.00) | Comp. No. 46 (2.4) | Y |
| 3 | Em-3 (1.30), Em-5 (2.00) | Comp. No. 10 (2.4) | X |
| 4 | Em-4 (1.30), Em-6 (2.00) | Comp. No. 10 (2.4) | X |
| 5 | Em-5 (1.30), Em-7 (2.00) | Comp. No. 10 (2.4) | X |
| 6 | Em-2 (1.30), Em-5 (2.00) | Comp. No. 10 (2.4) | Y |
| 7 | Em-1 (0.65), Em-2 (0.65) Em-4 (2.00) | Comp. No. 10 (2.4) | Y |
| 8 | Em-1 (0.65), Em-2 (0.65) Em-5 (2.00) | Comp. No. 22 (2.4) | Y |
| 9 | Em-8 | Comp. No. 10 (2.4) | X |
| 10 | Em-2 (1.50), Em-4 (2.30) | MC-2 (2.9) | X |
| 11 | Em-2 (1.30), Em-4 (2.00) | Comp. No. 10 (2.4) | Y |

Y: Present invention; X: Comparative example
The numerals in parentheses indicate coating weight, mg/dm$^2$, which is in terms of silver in the case of emulsions.

The resulting respective samples were exposed to light through an optical wedge with use of a sensitometer, and then processed according to the processing steps shown below.

(Processing 1)

| Processing steps | Time | Temperature |
|---|---|---|
| Color developing | 2 min. 30 sec. | 33° C. |
| Bleach-fixing | 40 sec. | 33° C. |
| Stabilizng | 20 sec., three times | 33° C. |
| Drying | 30 sec. | 60 to 80° C. |

(Color developing solution 1)

| | |
|---|---|
| Diethylenetriaminepentaacetic acid | 2.0 g |
| Benzyl alcohol | 12.8 g |

-continued

| | |
|---|---|
| Diethylene glycol | 3.4 g |
| Sodium sulfite | 2.0 g |
| potassium bromide | 0.5 g |
| Hydroxylamine sulfate | 2.6 g |
| Sodium chloride | 3.2 g |
| 3-methyl-4-amino-N-ethyl-N-(β-methanesulfonamidoethyl) aniline | 4.25 g |
| Potassium carbonate | 30.0 g |
| Brightening agent (a 4,4'diaminostilbenedisulfonic acid derivative) | 1.0 g |
| Made up by adding water, to | 1 l |
| pH | 10.5 |
| The pH was adjusted using potassium hydroxide and sulfuric acid. | |
| (Bleach-fixing solution) | |
| Ammonium thiosulfate (54 wt. %) | 150 cc |
| Sodium sulfite | 15 g |
| Ferric (III) ammonium ethylenediaminetetraacetate | 55 g |
| Sodium ethylenediaminetetraacetate (dihydrate) | 4 g |
| Glacial acetic acid | 8.61 g |
| Made up by adding water, to | 1 l |
| pH | 5.4 |
| The pH was adjusted using ammonia water or hydrochloric acid. | |
| (Stabilizing solution) | |
| 1-Hydroxyethylidene-1,1'-diphosphonic acid (60%) | 1.6 ml |
| Bismuth chloride | 0.35 g |
| Polyvinyl pyrrolidone | 0.25 g |
| Ammonia water | 2.5 ml |
| Trisodium nitrilotriacetate | 1.0 g |
| 5-Chloro-2-methyl-4-isothiazolin-3-on | 50 mg |
| 2-Octyl-4-isothiazolin-3-on | 50 mg |
| Brightening agent (4,4'-diaminostilbene type) | 1.0 g |
| Made up by adding water, to | 1 l |
| pH | 7.5 |
| (The pH was adjusted using potassium hydroxide or hydrochloric acid.) | |
| (Processing 2) | |
| Same as Processing 1 except that the pH of the color developing solution was adjusted to 10.8. | |
| (Processing 3) | |
| Same as Processing 1 except that the pH of the color developing solution was adjusted to 11.2. | |

Sensitometry was carried out on the resulting images, and the maximum density, straight line portion gamma, and straight line portion gamma/toe gamma were evaluated only about magenta images. Results obtained are shown in Table 4. Here, the toe gamma is indicated by an absolute value of the slope of the straight line portion connecting a density point of minimum density +0.15 and a density point of minimum density +0.5 in the characteristic curve. Also, the straight line portion gamma/toe gamma was evaluated as an index that shows the linearity of the characteristic curve.

TABLE 4

| Sample No. | Processing | Maximum density | Straight line portion gamma | Straight line portion gamma/toe gamma |
|---|---|---|---|---|
| | 1 | 2.12 | 1.35 | 1.12 |
| 1 (Y) | 2 | 2.20 | 1.36 | 1.21 |
| | 3 | 2.22 | 1.38 | 1.23 |
| | 1 | 2.13 | 1.43 | 1.10 |
| 2 (Y) | 2 | 2.18 | 1.46 | 1.16 |
| | 3 | 2.19 | 1.47 | 1.23 |
| | 1 | 1.96 | 1.16 | 1.05 |
| 3 (X) | 2 | 2.04 | 1.31 | 1.15 |
| | 3 | 2.11 | 1.45 | 1.33 |
| | 1 | 1.83 | 1.25 | 1.03 |
| 4 (X) | 2 | 1.92 | 1.40 | 1.14 |
| | 3 | 2.01 | 1.45 | 1.23 |
| | 1 | 1.73 | 1.27 | 1.01 |
| 5 (X) | 2 | 1.92 | 1.39 | 1.16 |
| | 3 | 1.98 | 1.46 | 1.21 |
| | 1 | 2.17 | 1.32 | 1.14 |
| 6 (Y) | 2 | 2.21 | 1.37 | 1.20 |
| | 3 | 2.22 | 1.42 | 1.19 |
| | 1 | 2.31 | 1.40 | 1.15 |
| 7 (Y) | 2 | 2.33 | 1.37 | 1.18 |
| | 3 | 2.35 | 1.42 | 1.21 |
| | 1 | 2.30 | 1.36 | 1.15 |
| 8 (Y) | 2 | 2.30 | 1.40 | 1.21 |
| | 3 | 2.31 | 1.42 | 1.23 |
| | 1 | 2.13 | 1.26 | 0.92 |
| 9 (X) | 2 | 2.19 | 1.45 | 1.17 |
| | 3 | 2.15 | 1.50 | 1.29 |
| | 1 | 2.00 | 1.29 | 1.06 |
| 10 (X) | 2 | 2.06 | 1.29 | 1.17 |
| | 3 | 2.11 | 1.42 | 1.26 |
| | 1 | 2.10 | 1.32 | 1.10 |
| 11 (Y) | 2 | 2.17 | 1.32 | 1.14 |
| | 3 | 2.18 | 1.34 | 1.16 |

(Y): Present invention; (X): Comparative example

As will be evident from the results shown in Table 4, the samples No. 1, No. 2, No. 6, No. 7, No. 8 and No. 11 of the present invention show a higher maximum density, a sufficiently high maximum density even with variation of the pH of the color developing solution, and a stableness in the straight line portion gamma/toe gamma ratio serving as an index that indicates the variation of the straight line portion gamma and the linearity of the characteristic curve.

EXAMPLE 2

(Preparation of Em-9)

A monodisperse silver chlorobromide emulsion Em-9 was prepared in the following manner. In a core emulsion comprising ossein gelatin and cubic silver chlorobromide (AgBr:AgCl=50:50 in molar ratio) of 0.15 μm in average grain size, sodium thiosulfate and sodium chloroaurate were added to effect chemical sensitization, and thereafter two kinds of aqueous solutions, an aqueous solution of silver nitrate and an aqueous solution containing potassium bromide and sodium chloride (KBr:NaCl=50:50 in molar ratio), were simultaneously added according to the controlled double jet method to obtain a cubic core/shell emulsion of 0.25 μm in average grain size. In the resulting emulsion, sodium thiosulfate and sodium chloroaurate were further added to effect chemical sensitization of the surfaces to an appropriate degree, thus obtaining an internal latent image core/shell emulsion Em-9.

(Preparation of Em-10)

Em-0 was prepared in the same manner as Em-9. Provided that a cubic silver chlorobromide emulsion of 0.32 μm was used as the core emulsion in place of the cubic silver chlorobromide emulsion of 0.15 μm, and also the covering with shells was so carried out that the core/shell emulsion may have an average grain size of 0.47 μm. In both emulsions, the silver halide composition of the core/shell emulsion was made to be AgBr:AgCl=50:50 in molar ratio.

Using the resulting Em-9 and Em-10, samples No. 12 to No. 14 were prepared in the same manner as the sample No. 1 in the above Example 2.

Provided that, in the green-sensitive emulsion layer, the magenta coupler and fogging agent only were made different as shown in Table 5, from those of the sample No. 1, in addition to the employment of Em-9 and Em-10.

TABLE 5

| Sample No. | Emulsion | Magenta coupler | Fogging agent (mol/molAg) |
|---|---|---|---|
| 12 | Em-9 (1.50), Em-10 (2.20) | Compound No. 22 | FA-2 ($4 \times 10^{-5}$) |
| 13 | Em-9 (1.50), Em-10 (2.20) | Compound No. 22 | FA-2 ($6 \times 10^{-5}$) |
| 14 | Em-9 (1.50), Em-10 (2.20) | Compound No. 22 | FA-2 ($1 \times 10^{-5}$) |

FA-2

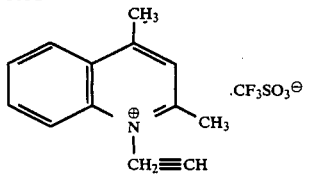

The resulting samples were subjected to the processing (Processing 1) in Example 1 using the color developing solution 1. They were also subjected to Processings 2 to 6, respectively, which were carried out by replacing the color developing solution 1 with color developing solutions 2 to 6 obtained by changing the composition in the color developing solution 1 only in respect of what are shown in Table 6.

TABLE 6

| Color developing solution No. | Composition | |
|---|---|---|
| 1 | Potassium carbonate 30 g | Hydroxylamine nitrate 2.6 g |
| 2 | Potassium carbonate 30 g | — |
| 3 | Potassium carbonate 30 g | Diethylhydroxylamine 2.4 g |
| 4 | Phosphoric acid (85%) 9 ml | Hydroxylamine nitrate 2.6 g |
| 5 | Phosphoric acid (85%) 9 ml | — |
| 6 | Phosphoric acid (85%) 9 ml | Diethylhydroxylamine 2.4 g |

Sensitometry was carried out on the resulting and the maximum density and minimum density were measured only in respect of magenta images to obtain the results shown in Table 7.

TABLE 7

| Color developing solution No. | Sample No. | Maximum density | Minimum density |
|---|---|---|---|
| 1 | 12 | 1.75 | 0.16 |
| | 13 | 2.09 | 0.18 |
| | 14 | 2.17 | 0.22 |
| 2 | 12 | 1.98 | 0.14 |

TABLE 7-continued

| Color developing solution No. | Sample No. | Maximum density | Minimum density |
|---|---|---|---|
| | 13 | 2.10 | 0.16 |
| | 14 | 2.13 | 0.17 |
| 3 | 12 | 2.08 | 0.14 |
| | 13 | 2.20 | 0.15 |
| | 14 | 2.22 | 0.16 |
| 4 | 12 | 1.97 | 0.14 |
| | 13 | 2.21 | 0.17 |
| | 14 | 2.24 | 0.19 |
| 5 | 12 | 2.25 | 0.15 |
| | 13 | 2.33 | 0.15 |
| | 14 | 2.37 | 0.16 |
| 6 | 12 | 2.29 | 0.13 |
| | 13 | 2.36 | 0.14 |
| | 14 | 2.38 | 0.15 |

The results shown in Table 7 tell that better photographic performances can be obtained when the phosphoric acid compound is used in the color developing solution and no hydroxylamine is contained in the color developing solution.

What is claimed is:

1. A direct positive silver halide photographic light-sensitive material which comprises a support having thereon a blue-sensitive emulsion layer containing a yellow color coupler, at least one green-sensitive emulsion layer and a red-sensitive emulsion layer containing a cyan color coupler and, is capable of forming a positive image by developing with a color developer in the presence of a fogging agent after exposure to light, wherein the green-sensitive emulsion comprises silver halide grains having at least two peaks on the size distribution curve thereof, where the grain size corresponding to the smallest grain size peak among said at least two peaks is not more than 0.3 μm; and at least one of the magenta coupler represented by the following Formula (M-1);

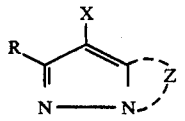

Formula (M-I)

wherein Z represents a group of non-metal atoms necessary to complete a nitrogen-containing heterocyclic ring which may have a substituent; X represents a hydrogen atom or a group capable of being split off upon reaction with the oxidized product of a color developing agent; and R represent a hydrogen atom or a substituent.

2. The material of claim 1, wherein said silver halide grains contained in said green sensitive emulsion layer have two peaks on the size distribution curve thereof.

3. The material of claim 1, wherein said silver halide grains contained in said green-sensitive emulsion layer have three peaks on the size distribution curve thereof.

4. The material of claim 1, wherein said grain size corresponding to the smallest grain size peak is within the range of from 0.05 μm to 0.3 μm.

5. The material of claim 1, wherein grain size at the peaks other than the smallest grain size peak is not more than 1.5 μm.

6. The material of claim 5, wherein grain size at the peaks other than the smallest grain size peak is not more than 1.0 μm.

7. The material of claim 6, wherein grain size at the peaks other than the smallest grain size peak is not more than 0.7 μm.

8. The material of claim 1, wherein difference of said peaks in grain size is not more than 10% based on a grain size corresponding to greater grain size peak.

9. The material of claim 1, wherein said green-sensitive emulsion layer comprises a plurality of emulsion layers each containing emulsions each of which has a single peak at different grain size from each other on the grain size distribution curve thereof.

10. The material of claim 1, wherein said green-sensitive emulsion layer comprises at least one layer of emulsion containing having at least two peaks on the grain size distribution curve thereof.

11. The material of claim 1, wherein said silver halide grains have core/shell structure.

12. The material of claim 1, wherein said silver halide grains are internal atent image type grains being not fogged on the surface thereof.

13. The material of claim 1, wherein said substituent represented by R in Formula (M-I) is an alkyl group, an aryl group, an anilino group, an acylamino group, a sulfonamido group, an alkylthio group, an arylthio group, an alkenyl group, a cycloalkyl group, a halogen atom, a cycloalkenyl group, an alkinyl group, a heterocyclic group, a sulfonyl group, a sulfinyl group, an acyl group, a carbamoyl group, a sulfamoyl group, a cyano group, an alkoxy group, an aryloxy group, a heterocyclic oxy group, a siloxy group, an acyloxy group, a carbamoyloxy group, an amino group, an alkylamino group, an imido group, a ureido group, a sulfamoylamino group, an alkoxycarbonylamino group, an aryloxycarbonylamino group, a heterocyclic thio group, a spyro compound residue or a bridged hydrocarbon compound residue.

14. The material of claim 1, wherein said group represented by the X in Formula (M-1) is a halogen atom, an alkoxy group, an aryloxy group, a heterocyclic oxy group, an acyloxy group, a sulfonyloxy group, an alkoxycarbonyloxy group, an aryloxycarbonyl group, an alkyloxalyloxy group, an alkoxyoxalyloxy group, an alkylthio group, an arylthio group, a heterocyclic thio group, an alkyloxythiocarbonyloxy group, an acylamino group, a sulfonamido group, a nitrogen-containing heterocyclic ring combined through N atom, an alkyloxycarbonylamino group, an aryloxycarbonylamino group, a carboxyl group or a group of

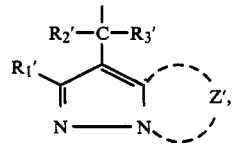

wherein $R_1'$ and Z' are each the same as R and Z in Formula 1 and $R_2'$ and $R_3'$ are each a hydrogen atom, an alkyl group, an aryl group or a heterocyclic group.

15. The material of claim 1, wherein said coupler is represented by the following Formula (M-II), (M-III), (M-IV), (M-V), (M-VI) or (VII);

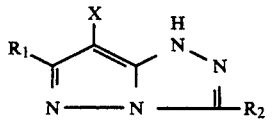

(M-II)

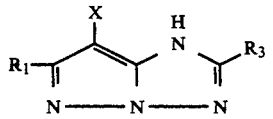

(M-III)

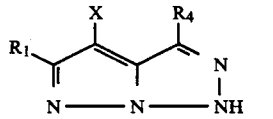

(M-IV)

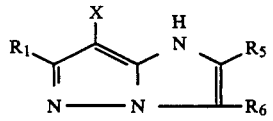

(M-V)

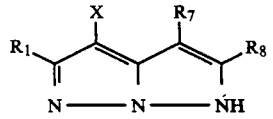

(M-VI)

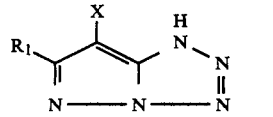

(M-VII)

wherein $R_1$ to $R_8$ and X are the same as R and X in Formula (M-I), respectively.

16. The material of claim 15, wherein said coupler is represented by the following Formula (M-VIII);

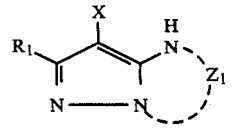

Formula (M-VIII)

wherein $R_1$, X and Z are the same as R, X and Z in Formula (M-I), respectively.

17. The material of claim 16, wherein said coupler is represented by Formula (M-II) or (M-III).

18. The material of claim 17, wherein said coupler is represented by Formula (M-II).

19. The material of claim 1, wherein said coupler is contained in said 9reen-sensitive emulsion layer in an amount of from $1\times10^{-3}$ to 1 mole per mole of silver halide.

20. The material of claim 1, wherein said material comprises said fogging agent.

21. The material of claim 20, wherein said fogging agent is contained in an amount of from 1 mg to 1500 mg per mole of silver halide.

22. A method for forming a direct positive image comprising a step for imagewise exposing to light a silver halide photographic light-sensitive material which comprises a support having thereon a blue-sensitive emulsion layer containing a yellow color coupler, at least one green-sensitive emulsion layer and a red-sensitive emulsion layer containing a cyan color coupler, and a step for developing said silver halide photographic light-sensitive material with a color developer in the presence of a fogging agent, wherein the green-sensitive emulsion comprises silver halide grains having at least two peaks on the size distribution curve thereof, where the grain size corresponding to the smallest grain size peak among said at least two peaks is not more than 0.3 μm; and at least one of the magenta coupler represented by the following Formula (M-1);

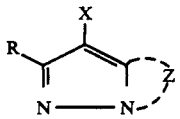

Formula (M-I)

wherein Z represents a group of non-metal atoms necessary to complete a nitrogen containing heterocyclic ring which may have a substituent; X represents a hydrogen atom or a group capable of being split off upon reaction with the oxidized product of a color developing agent; and R represent a hydrogen atom or a substituent.

23. The method of claim 22, wherein said developer contains a phosphoric acid compound.

24. The method of claim 23, wherein said phosphoric acid compound is a compound represented by the following Formula (P-I), (P-II) or (P-III)

$$) A^1{}_mP_mO_{3m}$$ Formula (P-I)

$$A^2, A^3, A^4{}_nP_nO_{3n+1}$$ Formula (P-II)

$$A^5, A^6, A^7PO_3$$ Formula (P-III)

wherein $A^1$ to $A^7$ each represent a hydrogen atom, an alkali metal atom or an alkyl group; m and n each represent an integer of from 1 to 20.

25. The method of claim 24, wherein said phosphoric acid compound is a compound represented by the following Formula (P-IV), (P-V), (P-VI), (P-VII), (P-VIII), (P-IX), (P-X) or (P-XI);

$$M_mP_mO_{3m}$$ Formula (P-IV)

$$M_{n+2}P_nO_{3n+1}$$ Formula (P-V)

wherein M represents an alkali metal atom; m and n each represent an integer of from 1 to 20;

$$B_1-R_{21}-Z-R_{22}-COOH$$ Formula (P-IV)

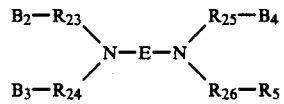

Formula (P-VII)

wherein E represents a substituted or unsubstituted alkylene group, a cycloalkylene group, a phenylene group, a $-R_{27}-$ group, a $-OR_{27}-$ group, a $-R_{27}-OR_{27}-OR_{27}-R_{27}-$ group or a $-R_{27}ZR_{27}-$ group; Z represents $=NR_{27}-B_6$ or $=NB_6$; $R_{21}$ to $R_{27}$ each represent a substituted or unsubstituted alkylene group; $B_1$ to $B_6$ each represent a hydrogen atom, a —OH group, a —COOM group, a $-PO_3M_2$ group, where at least one of $B_1$ and $B_6$ represents $-PO_3M_2$ group, at least one to $B_2$ to $B_5$ represents $-PO_3M_2$ group; and M represents a hydrogen atom or an alkali metal atom;

$$R_{28}N(CH_2PO_3M_2)_2$$ Formula (P-VIII)

wherein $R_{28}$ represents a lower alkyl group, an aralkyl group, a nitrogen-containing 6-membered ring group; M represents a hydrogen atom or an alkali metal atom;

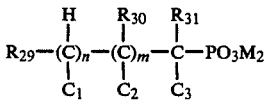

Formula (P-IX)

wherein $R_{29}$ to $R_{31}$ each represent a hydrogen atom, a —OH group, a lower alkyl group; $C_1$ to $C_3$ each represent a hydrogen atom, a —OH group, a —COOH group, —$PO_3M_3$ group, or $Nj_2$ group; where j represents a hydrogen atom, a lower alkyl group, a —$C_2H_4OH$ group or a —$PO_3M_2$ group; M represents a hydrogen atom or an alkali meta atom; and n and m each represent 0 or 1;

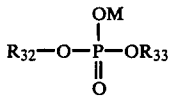

Formula (P-X)

wherein $R_{32}$ *and* $R_{33}$ each represent a hydrogen atom, an alkyl group having 1 to 12 carbon atoms, an alkenyl group, a cyclic alkyl group; and M represents a hydrogen atom or an alkali metal atom;

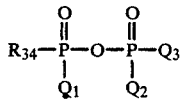

Formula (P-XI)

wherein $R_{34}$ representsan alkyl group having 1 to 12 carbon atoms, an alkoxy group having to 12 carbon atoms, a monoalkylamino group having 1 to 12 carbon atoms, a dialkylamino group having 1 to 12 carbon atoms, an amino group, an aryloxy group having 1 to 24 carbon atoms, an arylamino group having 6 to 24 carbon atoms or an amyloxy group; $Q_1$ to $Q_3$ each represent a —OH group, an alkoxy group, having 1 to 24 carbon atoms, an aralkyloxy group, an aryloxy group, —$OM_3$ group, where M is a cation, an amino group, a morophollino group, a cyclic amino group, an alkylamino group, a dialkylamino group, an arylamino group or an alkyloxy group.

26. The method of claim 23, wherein said phosphoric acid compound is contained in said color developer in an amount of 3 to 200 g/l.

27. The method of claim 22, wherein said color developer substantially not contains hydroxyamine.

28. The method of claim 22, wherein said color developer contains a hydoxylamine derivative represented by the following Formula (HA);

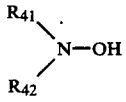

Formula (HA)

wherein $R_{41}$ and $R_{42}$ each represent a hydrogen atom or an alkyl group provided that both of $R_{41}$ and $R_2$ are not hydrogen atom in the same time; $R_{41}$ and $R_{42}$ may be combined to form a ring.

29. The method of claim 28, said hydroxylamine derivative is contained in said color developer in an amount of from 0.2 to 50 g/l.

30. The method of claim 22, said color developer contains said fogging agent.

31. The method of claim 30, said fogging agent is contained in said color developer in an amount of from 0.5 g/l to 30 g/l.

32. The method of claim 22, wherein said silver halide grains contained in said green sensitive emulsion layer have two peaks on the size distribution curve thereof.

33. The method of claim 22, wherein said silver halide grains contained in said green-sensitive emulsion layer have three peaks on the size distribution curve thereof.

34. The method of claim 22, wherein said grain size corresponding to the smallest grain size peak is within the range of from 0.05 μm to 0.3 μm.

35. The method of claim 22, wherein grain size at the peak other than the smallest grain size peak is not more than 1.5 μm.

36. The method of claim 35, wherein grain size at the peak other than the smallest grain size peak is not more than 1.0 μm.

37. The method of claim 36, wherein grain size at the peak other than the smallest grain size peak is not more than 0.7 μm.

38. The method of claim 22, wherein difference of said peaks in grain size is not more than 10 % based on a grain size corresponding to greater grain size peak.

39. The method of claim 22, wherein said green-sensitive emulsion layer comprises a plurality of emulsion layers each containing emulsions each of which has a single peak at different grain size from each other on the grain size distribution curve thereof.

40. The method of claim 22, wherein said green-sensitive emulsion layer comprises at least one layer containing an emulsion having at least two peaks on the grain size distribution curve thereof.

41. The method of claim 22, wherein said silver halide grains have core/shell structure.

42. The method of claim 22, wherein said silver halide grains are internal latent image type grains being not fogged on the surface thereof.

43. The method of claim 22, wherein said substituent represented by R in Formula (M-1) is an alkyl group, an aryl group, an anilino group, an acylamino group, a sulfonamido group, an alkylthio group, an arylthio group, an alkenyl group, a cycloalkyl group, a halogen atom, a cycloalkenyl group, an alkinyl group, a heterocyclic group, a sulfonyl group, a sulfinyl group, an acyl group, a carbamoyl group, a sulfamoyl group, a cyano group, an alkoxy group, an aryloxy group, a heterocyclic oxy group, a siloxy group, an acyloxy group, a carbamoyloxy group, an amino group, an alkylamino group, an imido group, a ureido group, a sulfamoylamino group, an alkoxycarbonylamino group, an aryloxycarbonylamino group, a heterocyclic thio group, a spyro compound residue or a bridged hydrocarbon compound residue.

44. The method of claim 22, wherein said group represented by the X in Formula (M-1) is a halogen atom, an alkoxy group, an arloxy group, a heterocyclic oxy group, an acyloxy group, a sulfonyloxy group, an alkoxycarbonyloxy group, an aryloxycarbonyl group, an alkyloxalyloxy group, an alkoxyoxalyloxy group, an alkylthio group, an arylthio group, a heterocyclic thio group, an alkyloxythiocarbonyloxy group, an acylamino group, a sulfonamido group, a nitrogen-containing heterocyclic ring combined through N atom, an alkyloxycarbonylamino group, an aryloxycarbonylamino group, a carboxyl group or a group of

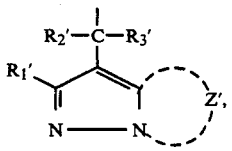

wherein $R_1'$ and $Z'$ are each the same as R and Z in Formula 1 and $R_2'$ and $R_3'$ are each a hydrogen atom, an alkyl group, an aryl group or a heterocyclic group.

45. The method of claim 22, wherein said coupler is represented by the following Formula (M-II), (M-III), (M-IV), (M-V), (M-VI) or (VII);

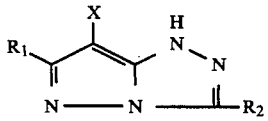

(M-II)

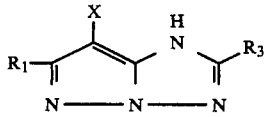

(M-III)

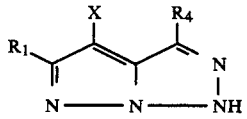

(M-IV)

-continued

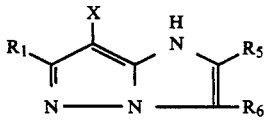

(M-V)

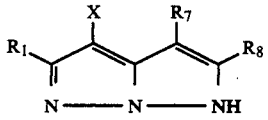

(M-VI)

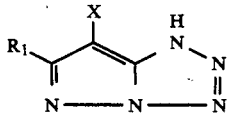

(M-VII)

wherein $R_1$ to $R_8$ and X are the same as R and X in Formula (M-I), respectively.

46. The method of claim 22, wherein said coupler is represented by the following Formula (M-VIII);

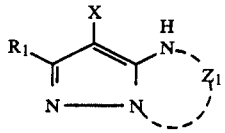

Formula (M-VIII)

wherein $R_1$, X and Z are the same as R, X and Z in Formula I, respectively.

47. The method of claim 46, wherein said coupler is represented by Formula (M-II) or (M-III).

48. The method of claim 47, wherein said coupler is represented by Formula (M-II).

49. The method of claim 22, wherein said coupler is contained in said green-sensitive emulsion layer in an amount of from $1\times10^{-3}$ to 1 mole per mole of silver halide.

50. The method of claim 22, wherein said silver halide photographic light sensitive material comprises said fogging agent.

51. The method of claim 50, wherein said fogging agent is contained in an amount of from 1 mg to 1500 mg per mole of silver halide.

* * * * *